US005221494A

United States Patent [19]

Ikeda et al.

[11] Patent Number: 5,221,494

[45] Date of Patent: Jun. 22, 1993

[54] REFRIGERANT COMPOSITION COMPRISING TETRAFLUOROETHANE REFRIGERANT AND LUBRICANT HAVING MISCIBILITY THEREWITH AT LOW TEMPERATURE

[75] Inventors: Masanori Ikeda, Fuji; Hiroyuki Fukui, Numazu; Yoshio Suzuki, Fuji, all of Japan

[73] Assignee: Asahi Kasei Kogyo Kabushiki Kaisha, Osaka, Japan

[21] Appl. No.: 582,847

[22] PCT Filed: Jun. 5, 1990

[86] PCT No.: PCT/JP90/00731

§ 371 Date: Oct. 15, 1990

§ 102(e) Date: Oct. 15, 1990

[87] PCT Pub. No.: WO90/15122

PCT Pub. Date: Dec. 13, 1990

[30] Foreign Application Priority Data

| | | | |
|---|---|---|---|
| Jun. 5, 1989 | [JP] | Japan | 1-141173 |
| Sep. 14, 1989 | [JP] | Japan | 1-237123 |
| Jan. 25, 1990 | [JP] | Japan | 2-13580 |

[51] Int. Cl.[5] ..... C10M 105/54; C10M 107/38; C10N 40/30

[52] U.S. Cl. ..... 252/68; 252/54; 252/54.6; 252/67

[58] Field of Search ..... 252/67, 68, 54, 54.6; 560/180; 562/583

[56] References Cited

U.S. PATENT DOCUMENTS

| | | | |
|---|---|---|---|
| 3,250,807 | 5/1966 | Fritz et al. | 560/180 |
| 3,250,808 | 5/1966 | Moore, Jr. et al. | 252/54.6 |
| 3,317,484 | 5/9167 | Fritz et al. | 524/881 |
| 3,654,273 | 4/1972 | Schuman et al. | 544/216 |
| 3,660,315 | 5/1972 | Hill et al. | 528/402 |
| 3,845,051 | 10/1974 | Zollinger | 544/216 |
| 4,178,465 | 12/1979 | Caporiccio et al. | 252/52 A |
| 4,356,291 | 10/1982 | Darling | 525/403 |
| 4,597,882 | 7/1986 | Nishimura et al. | 252/51 |
| 4,647,413 | 3/1987 | Savu | 560/180 |
| 4,755,316 | 7/1988 | Magid et al. | 252/68 |
| 4,931,199 | 6/1990 | Bierschenk et al. | 252/68 |
| 5,000,864 | 3/1991 | Strepparola et al. | 252/54.6 |

FOREIGN PATENT DOCUMENTS

| | | |
|---|---|---|
| 51-2083 | 1/1976 | Japan . |
| 52-16561 | 2/1977 | Japan . |
| 53-5360 | 2/1978 | Japan . |
| 57-175185 | 10/1982 | Japan . |
| 60-96684 | 5/1985 | Japan . |
| 61-233088 | 10/1986 | Japan . |
| 62-146996 | 6/1987 | Japan . |
| 62-288692 | 12/1987 | Japan . |
| 1-118598 | 5/1989 | Japan . |

OTHER PUBLICATIONS

Abstract of Internationales Jahrbuch der Tribologie (International Yearbook of Tribology, 1, 383–93, 1982.

*Primary Examiner*—Christine Skane

*Attorney, Agent, or Firm*—Birch, Stewart, Kolasch & Birch

[57] ABSTRACT

A lubricant for use in a refrigeration system using a tetrafluoroethane refrigerant, which comprises a fluorine-containing compound represented by the following formula:

$$A[(OC_nF_{2n})_m(OC_lF_{2l})_{m'}X]_p \quad (I)$$

wherein X represents a multiple bond-containing monovalent group, and A represents a mono-, bi- or trivalent unsubstituted or partially substituted perfluorocarbon residue, a mono, bi- or trivalent unsubstituted or partially substituted perfluoroether residue or a mono-, bi- or trivalent unsubstituted or partially substituted perfluoropolyether residue.

This lubricant has a good miscibility with a tetrafluoroethane refrigerant as represented by HFC-134*a* over a wide range of temperatures ranging from the low temperature to the high temperature and is excellent in properties, such as heat resistance, lubricating properties, electrically insulating properties and viscosity-temperature characteristics.

5 Claims, No Drawings

REFRIGERANT COMPOSITION COMPRISING TETRAFLUOROETHANE REFRIGERANT AND LUBRICANT HAVING MISCIBILITY THEREWITH AT LOW TEMPERATURE

TECHNICAL FIELD

The present invention relates to a refrigerant composition. More particularly, the present invention relates to a lubricant-containing refrigerant composition suitable for use in a refrigeration system employing as a refrigerant a tetrafluoroethane, preferably HFC-134*a* (1,1,1,2-tetrafluoroethane), which is promising as a substitute for CFC-12 (1,1-dichloro-1,1-difluoromethane) with a viewpoint of environment protection.

BACKGROUND ART

At present, CFC-12 is mainly used as a refrigerant for car air conditioners and refrigerators. However, development of a refrigerant which can be used as a substitution for CFC-12 has been desired with a viewpoint of protection of the ozone layer.

HFC-134*a* as a refrigerant has properties similar to those of CFC-12, and it can be used as a substitute for CFC-12 with only minor changes of equipment being necessary. Likewise, HFC-134 (1,1,2,2-tetrafluoroethane), which is an isomer of HFC-134*a*, can also be used.

In a refrigeration system using CFC-12, mineral oil is used as a lubricant for a compressor. CFC-12 is miscible with mineral oil over a wide temperature range and therefore, even in the refrigeration system where evaporation and condensation of the refrigerant are repeated, phase separation of the refrigerant from the lubricant does not occur.

However, HFC-134*a* is not satisfactorily miscible with mineral oil. Therefore, when mineral oil is used, the mineral oil is replaced by the refrigerant, for example, in a compressor, causing various serious problems. For example, the lubrication becomes unsatisfactory and the lubricant adheres to the inner wall of a heat exchanger, leading to a lowering of the heat exchange efficiency.

The lubricant for a refrigerator using HFC-134*a* as the refrigerant should be miscible with HFC-134*a* at least over a temperature range of from 0° to 50° C., preferably over a wide temperature range of from −20° to 70° C., more preferably over a wider temperature range of from −40° to 90° C., and most preferably over a still wider temperature range.

The lubricant should have a kinetic viscosity of from 3 to 500 centistokes (hereinafter, frequently abbreviated as "cst") at 40° C., preferably from 5 to 300 cst at 40° C., more preferably from 5 to 170 cst at 40° C., and most preferably form 10 to 150 cst at 40° C., for exerting excellent lubricating performances.

Accordingly, development of a lubricant having a desired viscosity and being miscible with HFC-134*a* over a wide temperature range has been desired.

Various polyoxyalkylene glycol substances have been proposed as the lubricant to be used in combination with HFC-134*a*. Particularly, a polyoxyalkylene glycol having at least two hydroxyl groups (specifically, polyoxypropylene glycol), disclosed in the specification of U.S. Pat. No. 4,755,316, is taught to exhibit a good miscibility with HFC-134*a* over a wide temperature range. However, the temperature range over which this lubricant is miscible with HFC-134*a* is still unsatisfactory, and improvement of the miscibility, especially at high temperatures, is required.

Polyoxyalkylene glycols have not only unsatisfactory lubrication properties under application conditions, but also high moisture absorption properties and therefore, various problems are likely to arise with respect to, for example, the freezing of water, corrosion of metals, and lowering of the volume resistivity (such a lowering of the volume resistivity causes a problem in the case of a closed type freezer, such as a refrigerator). Accordingly, polyoxyalkylene glycols are not an excellent lubricant for a refrigeration system from a practical point of view.

A perfluoropolyether oil appears to be a lubricant miscible with HFC-134*a* which is a fluorine-containing compound.

Various perfluoroether oils having different structures can be mentioned. For example, there can be mentioned oils comprised mainly of recurring units, which may be either of a single type or of a plurality of types, represented by the following formula (V):

$$\left(C_{n'}F_{2n'}O\right) \qquad \text{(V)}$$

wherein n′ is 1, 2 or 3 with the proviso that n′ is not simultaneously 1 with respect to all of the recurring units of the perfluoroether portion.

Specific examples of perfluoroether oils include those, which are available in the market as a vacuum pump oil and a lubricating oil, having a terminal stabilized with a perfluoroalkyl group, as shown below:

$$F\left(CF(CF_3)CF_2O\right)_{q1}CF_2CF_3,$$

$$F\left(CF_2CF_2CF_2O\right)_{q2}CF_2CF_3,$$

$$CF_3O\left(CF(CF_3)CF_2O\right)_{q3}\left(CF_2O\right)_{q4}CF_3,$$

and $$CF_3O\left(CF_2CF_2O\right)_{q5}\left(CF_2O\right)_{q6}CF_3.$$

wherein $q_1$, $q_2$, $q_3$, $q_4$, $q_5$ and $q_6$ are each a positive integer.

The present inventors examined the miscibility of these various perfluoropolyether oils with HFC-134*a*, and found that each oil shows a good miscibility with HFC-134*a* at temperatures higher than about room temperature, but oils, except those having a low molecular weight, are unsatisfactory in the miscibility with HFC-134*a* at low temperatures below 0° C. Accordingly, it was confirmed that these oils are not suitable as a lubricant for a refrigeration system employing HFC-134*a* as the refrigerant.

In Japanese Unexamined Patent Application Publication No. 60-96684, it is taught that when a fluorolubricant, such as a fluorinated silicone or a perfluoropolyether, is used in a fluorocarbon motive fluid for a heat pump, the heat resistance of a fluorocarbon refrigerant is improved. However, no description is made with respect to the miscibility of a tetrafluoroethane with a fluoro-lubricant. Japanese Unexamined Patent Application Publication No. 1-118598 teaches that a perfluoropolyether and/or a fluorinated silicone can be used as a lubricant for fluorocarbon refrigerants. However, with respect to the miscibility at low temperatures below about room temperature, no description is made.

In Japanese Unexamined Patent Publication Application No. 62-146996, it is taught that addition of up to 5% by weight of a carboxyl group- or hydroxyl group-containing perfluoropolyether derivative as an extreme pressure additive to a lubricant is effective. However, no description is made with respect to the miscibility of this carboxyl group- or hydroxyl group-containing perfluoropolyether derivative with a fluorocarbon refrigerator, such as a tetrafluoroethane.

In Japanese Examined Patent Application Publication No. 51-2083 and the specification of U.S. Pat. No. 3,654,273, it is taught that a perfluoropolyether type triazine compound can be used as a lubricant, but no description is made with respect to the miscibility of this compound with a fluorocarbon refrigerant, such as a tetrafluoroethane. The lubricating performances of a perfluoropolyether type triazine compound and poly(-hexafluoropropylene oxide) are described in Internationales Jahrbuch der Tribologie (International Yearbook of Tribology), 1, 383 (1982), but the miscibility properties of these compounds with a fluorocarbon refrigerant, such as a tetrafluoroethane, are not described at all.

In these situations, the present inventors have made researches with a view toward developing a substance showing not only a good miscibility with a tetrafluoroethane, such as HFC-134*a*, over a wide temperature range of from low temperatures to high temperatures, but also a viscosity ensuring satisfactory lubricating performances. As a result, it has been found that a fluorine-containing compound having a specific viscosity and having a structure represented by formula (I) defined herein or a composition comprising at least 25% by weight of this fluorine-containing compound and the balance of other oil, has not only a good miscibility with a tetrafluoroethane, such as HFC-134*a* but also a viscosity suitable for a lubricant for a refrigeration system and, is therefore suitable as a lubricant for use in a refrigeration system using a refrigerant comprising a tetrafluoroethane, such as HFC-134*a*. The present invention has now been completed, based on this finding.

It is therefore a primary object of the present invention to provide a novel lubricant for use in a refrigeration system, which exhibits not only a good miscibility with a tetrafluoroethane, such as HFC-134A which is a refrigerant promising as a substitute for CFC-12, over a wide temperature range of from low temperatures to high temperatures, but has also a viscosity suitable for a lubricant for use in a refrigeration system.

Another object of the present invention is to provide a refrigerant composition comprising the above-mentioned lubricant for use in a refrigeration system and a tetrafluoroethane refrigerant.

These and other objects, characteristic features and advantages of the present invention will become apparent from the following detailed description and the appended claims.

DISCLOSURE OF THE INVENTION

In accordance with the present invention, there is provided a refrigerant composition for use in a refrigeration system, comprising:

(a) a tetrafluoroethane refrigerant, and (b) a lubricant selected from the group consisting of a fluorine-containing compound (I) and a lubricating composition comprising the compound (I) in an amount of at least 25% by weight, based on the weight of the lubricating composition, the lubricant having a kinetic viscosity of from 3 to 500 centistokes at 40° C., the compound (I) being represented by the formula:

$$A\left[\left(OC_nF_{2n}\right)_m\left(OC_lF_{2l}\right)_{m'}X\right]_p \qquad \text{(I)}$$

wherein:

X is a multiple bond-containing monovalent group selected from the group consisting of:

(i) a carbonyl-containing group of the formula:

$$-\underset{\underset{O}{\|}}{C}-Y \qquad \text{(II)}$$

wherein Y represents a hydroxyl group, an unsubstituted or partially substituted alkoxy group having from 1 to 300 carbon atoms, an unsubstituted or partially substituted aryloxy group having from 6 to 300 carbon atoms, an unsubstituted or partially substituted alkylthio group having from 1 to 300 carbon atoms, an unsubstituted or partially substituted arylthio group having from 6 to 300 carbon atoms, an unsubstituted or partially substituted amino group having from 0 to 300 carbon atoms, an unsubstituted or partially substituted monovalent aliphatic hydrocarbon residue having from 1 to 100 carbon atoms, or an unsubstituted or partially substituted monovalent aromatic hydrocarbon residue having from 6 to 100 carbon atoms, (ii) a nitrile group and (iii) a triazine ring-containing group of the formula:

(III)

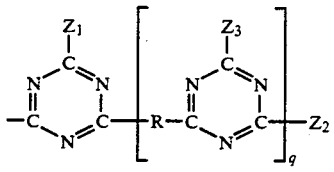

wherein R represents an unsubstituted or partially substituted bivalent perfluoropolyether residue having from 3 to 200 carbon atoms, an unsubstituted or partially substituted bivalent perfluoroether residue having from 2 to 60 carbon atoms, an unsubstituted or partially substituted bivalent perfluorocarbon residue having from 1 to 30 carbon atoms; $Z_1$, $Z_2$ and $Z_3$ each independently represent an unsubstituted or partially substituted monovalent perfluoropolyether having from 3 to 200 carbon atoms, an unsubstituted or partially substituted monovalent perfluoroether residue having from 2 to 60 carbon atoms, or an unsubstituted or partially substituted monovalent perfluoroalkyl group having from 1 to 30 carbon atoms, and q is an integer of from 0 to 20;

p is an integer of from 1 to 3;

A represents an unsubstituted or partially substituted mono-, bi- or trivalent perfluorocarbon residue having from 1 to 15 carbon atoms, or an unsubstituted or partially substituted mono-, bi- or trivalent perfluoroether residue having from 2 to 15 carbon atoms, or an unsubstituted or partially substituted mono-, bi- or trivalent perfluoropolyether having from 3 to 15 carbon atoms;

l is an integer of from 1 to 3;

m is an integer of from 0 to 80;

m' is 0 or 1; and n is an integer of from 1 to 4;

wherein when p and/or m is not smaller than 2, the units of $-(OC_nF_{2n})-$ are the same or different and are not replaced or are replaced with a unit or units of the formula:

$$-(CF_2-\underset{\underset{B-X'}{|}}{CF}-O)- \quad \text{(IV)}$$

wherein B represents a bivalent perfluorocarbon residue having from 1 to 15 carbon atoms, a bivalent perfluoroether residue having from 2 to 15 carbon atoms, or a bivalent perfluoropolyether residue having from 3 to 15 carbon atoms, and X' has the same meaning as defined for X of formula (I), with the proviso that the number of a unit or units of $-OC_nF_{2n}-$ replaced by a unit or units of the formula (IV) is not greater than 30% of the total number of the units of $-OC_nF_{2n}-$; and wherein when p is not smaller than 2, the multiple bond-containing monovalent X groups are the same or different.

As mentioned above, the present invention has been completed, based on the novel finding that a compound comprising a fluorine-containing group and a multiple bond-containing group as indispensable constituents surprisingly shows excellent miscibility with HFC-134*a* and is valuable as a lubricant for use in a refrigeration system using HFC-134*a* as a refrigerant.

The present invention will now be described in detail.

In the lubricant having a structure represented by formula (I), which is used in the present invention, n of the unit of $-OC_nF_{2n}-$ is an integer of from 1 to 4. Specific examples of units of $-(C_nF_{2n})-$ include units of the following structures:

$$-(O\overset{\overset{CF_3}{|}}{C}FCF_2)-, \quad \text{(VI-1)}$$

$$-(OCF_2CF_2CF_2)-, \quad \text{(VI-2)}$$

$$-(OCF_2CF_2)-, \quad \text{(VI-3)}$$

$$-(OCF_2)-, \quad \text{(VI-4)}$$

$$-(OCF_2CF_2CF_2CF_2)-, \quad \text{(VI-5)}$$

and $$\left[-O-\overset{\overset{CF_3}{|}}{\underset{\underset{CF_3}{|}}{C}}-CF_2-\right] \quad \text{(VI-6)}$$

In formula (I), the value of m representing the number of units $-OC_nF_{2n}-$ depends on the value of p but is generally an integer of from 0 to 80, preferably an integer of from 0 to 60, and more preferably an integer of from 0 to 40.

In formula (I), l is an integer of from 1 to 3. Specific examples of units of $-(OC_lF_{2l})-$ include units of the following structures:

$$-OCF_2-,\ -OCF_2CF_2-,\ -O\overset{\overset{CF_3}{|}}{C}F-,$$

$$OCF_2CF_2CF_2-,\ \text{and}\ -O-\overset{\overset{CF_3}{|}}{\underset{\underset{CF_3}{|}}{C}}-.$$

In formula (I), p is an integer of from 1 to 3.

A of formula (I) represents a mono-, bi- or trivalent perfluorocarbon residue having from 1 to 15 carbon atoms, preferably from 2 to 10 carbon atoms, a mono-, bi- or trivalent perfluoroether residue having from 2 to 15 carbon atoms, preferably from 2 to 10 carbon atoms, or a mono-, bi- or trivalent perfluoropolyether residue having from 3 to 15 carbon atoms, preferably from 3 to 10 carbon atoms.

Fluorine atoms of A can be substituted with a hydrogen atom, a chlorine atom, a bromine atom, a iodine atom or the above-mentioned multiple bondcontaining monovalent group X (described in detail hereinafter), with the proviso that the number of substituted fluorine atom or atoms is not greater than 50%, preferably not greater than 30%, of the total number of fluorine atoms of unsubstituted A.

Specific examples of A include the following groups:

$$CF_3CF_2-,\ CF_3CF_2CF_2-,\ CF_3(CF_2)_3,\ CF_3(CF_2)_6,$$

$$CF_3(CF_2)_9,\ (CF_3)_2CF-,\ CF_3CF_2-\overset{\overset{CF_3}{|}}{\underset{\underset{CF_3}{|}}{C}}-,\ H(CF_2)_n,$$

$$H(CF_2)_5,\ ICF_2CF_2O(CF_2)_{2\sim7},\ -CF_2CF_2-,$$

$$(CF_2)_4,\ (CF_2)_5,\ (CF_2)_6,\ -CF_2-\overset{\overset{CF_3}{|}}{C}F-CF_2-,$$

$$NC-\overset{\overset{CF_3}{|}}{C}FCF_2-,\ MeO_2CCF_2CF_2-,$$

$$-CF_2\overset{\overset{CF_3}{|}}{C}FOCF_2CF_2O\overset{\overset{CF_3}{|}}{C}FCF_2-,$$

$$-CF_2CF_2-\underset{\underset{|}{}}{CF}-CF_2CF_2-,\ CF_3CF_2CF_2O\overset{\overset{CF_3}{|}}{C}FCF_2-,$$

$$BrCF_2CF_2-,\ \text{and}\ ClCF_2CF_2-.$$

In the formulae described in the instant specification, Me Et and Bu represent a methyl group, an ethyl group and a butyl group, respectively.

The multiple bond-containing monovalent group X of formula (I) is a multiple bond-containing monovalent group selected from the group consisting of:

(i) a carbonyl-containing group of the formula:

$$-\underset{\underset{O}{\|}}{C}-Y \quad \text{(II)}$$

wherein Y represents a hydroxyl group, an unsubstituted or partially substituted alkoxy group having from 1 to 300 carbon atoms, an unsubstituted or partially substituted aryloxy group having from 6 to 300 carbon atoms, an unsubstituted or partially substituted alkylthio group having from 1 to 300 carbon atoms, an unsubstituted or partially substituted arylthio group having from 6 to 300 carbon atoms, an unsubstituted or partially substituted amino group having from 0 to 300 carbon atoms, an unsubstituted or partially substituted monovalent aliphatic hydrocarbon residue having from 1 to 100 carbon atoms, or an unsubstituted or partially substituted monovalent aromatic hydrocarbon residue having from 6 to 100 carbon atoms, (ii) a nitrile group and (iii) a triazine ring-containing group of the formula:

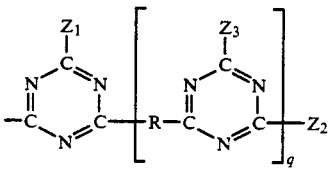

(III)

wherein R represents an unsubstituted or partially substituted bivalent perfluoropolyether residue having from 3 to 200 carbon atoms, an unsubstituted or partially substituted bivalent perfluoroether residue having from 2 to 60 carbon atoms, an unsubstituted or partially substituted bivalent perfluorocarbon residue having from 1 to 30 carbon atoms; $Z_1$, $Z_2$ and $Z_3$ each independently represent an unsubstituted or partially substituted monovalent perfluoropolyether having from 3 to 200 carbon atoms, an unsubstituted or partially substituted monovalent perfluoroether residue having from 2 to 60 carbon atoms, or an unsubstituted or partially substituted monovalent perfluoroalkyl group having from 1 to 30 carbon atoms, and q is an integer of from 0 to 20;

When p in formula (I) is 2 or 3, X groups may be the same or different.

The multiple bond-containing monovalent group X will now be described in detail.

Where Y of the carbonyl group-containing group (II) represented by formula (II) is an alkoxy group, an aryloxy group, an alkylthio group or an arylthio group, that is, where the group (II) is an ester group or a thioester group, a variety of ester groups or thioesters having different structures can be used, but preferably, groups represented by the following formula (VII) or (VII'):

$$-COOR_1 \qquad \text{(VII)}$$

or $$-COSR_1 \qquad \text{(VII')}$$

are used. In formula (VII) or (VII'), $R_1$ represents a group having from 1 to 300 carbon atoms, which is selected from groups ①, ②, ③ and ④ described below.

① An aliphatic or aromatic group having from 1 to 30 carbon atoms, preferably from 1 to 16 carbon atoms, more preferably from 1 to 12 carbon atoms.

② An organic group having from 1 to 80 of, preferably from 1 to 60 of, more preferably from 1 to 40 of linkage groups selected from an ether group, an amino groups and an Si-O bond in the main chain. The molecular weight of this organic group depends on the number of ether groups, amino groups or Si-O bonds, but the molecular weight is generally from 45 to 5,000, preferably from 45 to 3,000, more preferably 45 to 2,000. The number of carbon atoms per linkage group selected from an ether group, an amino group and an Si—O bond in the organic group is generally up to 30, preferably from 2 to 20, more preferably from 2 to 10. The number of carbon atoms of the organic group is generally from 2 to 300, preferably from 2 to 200, more preferably from 2 to 100.

The organic groups can assume various structures, examples of which include groups represented by the following formula (VII-1):

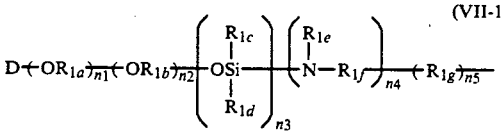

(VII-1)

wherein D represents a hydrogen atom or an aliphatic or aromatic hydrocarbon group having from 1 to 20 carbon atoms, preferably from 1 to 10 carbon atoms, $R_{1a}$ represents an alkylene group having from 2 to 4 carbon atoms, $R_{1b}$ represents an aliphatic or aromatic hydrocarbon group having from 5 to 20 carbon atoms, $R_{1c}$ and $R_{1d}$ each represent an aliphatic or aromatic hydrocarbon group having from 1 to 10 carbon atoms, $R_{1e}$ represents a hydrogen atom or an aliphatic or aromatic hydrocarbon group having from 1 to 10 carbon atoms, $R_{1f}$ and $R_{1g}$ each represent an aliphatic or aromatic hydrocarbon group having from 1 to 20 carbon atoms, preferably from 1 to 15 carbon atoms, $n_1$, $n_2$, $n_3$ and $n_4$ each represent 0 or a positive integer, with the proviso that the sum of $n_1$, $n_2$, $n_3$ and $n_4$ is generally from 1 to 80, preferably from 1 to 60, more preferably from 1 to 40, and $n_5$ is 0 or 1.

③ A group formed by substituting organic group ① or ② mentioned above with a substituent having up to 8 carbon atoms.

Examples of substituents having up to 8 carbon atoms include (a) an aliphatic or aromatic hydrocarbon group, (b) a polar substituent, such as a hydroxyl group, an alkoxy group, an amino group, an ester group, an amide group, a ketone group, a carboxyl group, a nitrile group or a sulfonyl group, (c) a group containing the polar substituent mentioned above, (d) a halogen atom, such as a fluorine atom, a chlorine atom or a bromine atom, and (e) a group containing the halogen atom mentioned above.

The substituted group may be a group formed by substituting a part of the hydrogen atoms of organic group ① or ② with the above-mentioned substituent having up to 8 carbon atoms, or a group formed by substituting the methylene groups of the main chain of organic group ① or ② with an ester linkage, an amide linkage, a ketone group or a sulfonyl group.

④ A substituted group formed by substituting the hydrogen atom of the C—H bond, O—H bond or N—H bond of organic group or ①, ② or ③ with a group represented by the following formula (VII-2):

$$A_1\text{-}(OC_nF_{2n})_m\text{-}(OC_lF_{2l})_{m'}\text{-}\underset{\underset{O}{\|}}{C}- \qquad \text{(VII-2)}$$

wherein l, m, m' and n are as defined for l, m, m' and n of formula (I), and $A_1$ represents a monovalent group as defined for A of formula (I).

The number of the substituent or substituents having up to 8 carbon atoms in the substituted group (3) per one $R_1$ and the number of the substituent or substituents of formula (VII-2) per one $R_1$ are each generally from 1 to 6, preferably from 1 to 3, more preferably 1. The number of carbon atoms of the substituted group or (3) (4) is generally from 1 to 300, preferably from 2 to 100.

Examples of $R_1$ groups include the following groups:

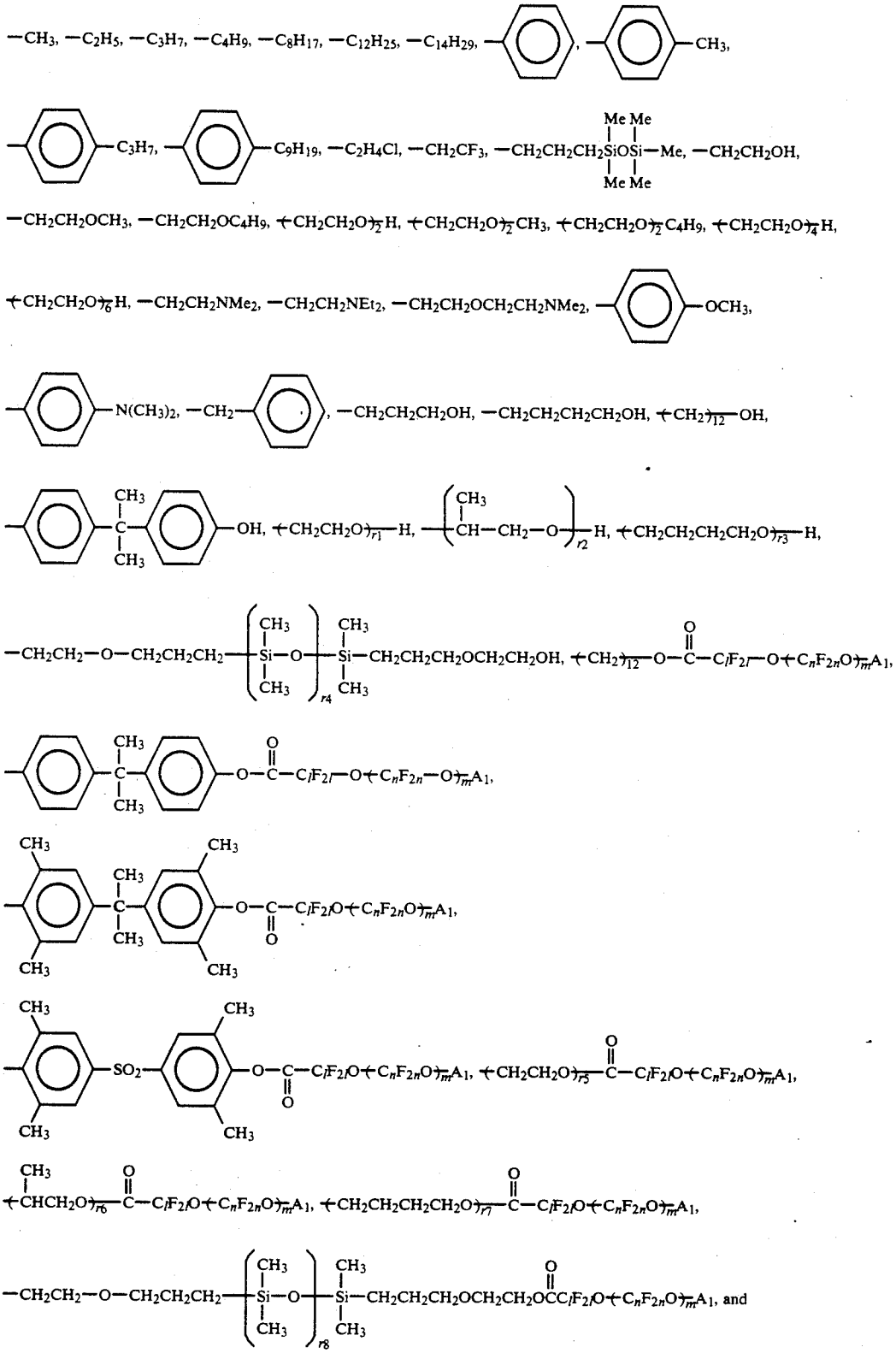

-continued $$-\overset{CH_3}{\overset{|}{C}}-[O-\overset{O}{\overset{\|}{C}}-C_lF_{2l}O\leftarrow C_nF_{2n}O\rightarrow_m A_1]_2,$$

wherein $r_1$, $r_2$, $r_3$, $r_4$, $r_5$, $r_6$, $r_7$ and $r_8$ represent a positive integer, l, m and n are as defined for l, m and n of formula (I), and $A_1$ is a monovalent group as defined for A of formula (I).

Where Y is an amino group, that is, the group (II) is an amide group, a variety of groups having different structures can be used as the carbonyl-containing group represented by formula (II), preferred examples of which are those represented by the following formula (VIII):

$$-CON\begin{matrix}R_2\\R_3\end{matrix} \qquad \text{(VIII)}$$

wherein $R_2$ and $R_3$ each represent a hydrogen atom or the same substituent as $R_1$ of formula (VII), with the proviso that $R_2$ and $R_3$ may be bonded together to form a cyclic structure. The number of carbon atoms in the amino group $$-N\begin{matrix}R_2\\R_3\end{matrix}$$

of formula (VIII) is generally from 0 to 300, preferably from 0 to 200, more preferably from 0 to 100.

Specific examples of amide groups represented by formula (VIII) include the following groups:

$-CONH_2$, $-CONHMe$, $-CONHEt$, $-CONHBu$, $-CONH(C_8H_{17})$, $-CONH(C_{12}H_{25})$, $-CONMe_2$, $-CONBu_2$, $-CON\begin{matrix}CH_2-CH_2\\CH_2-CH_2\end{matrix}CH_2$, $-CON\begin{matrix}CH_2-CH_2\\CH_2-CH_2\end{matrix}O$, $-CON\begin{matrix}CH=CH\\CH=CH\end{matrix}$, $-CONHCH_2CH_2OH$, $-CON(CH_2CH_2OH)_2$, $-CONHCH_2CH_2NH_2$, $-CONH(CH_2)_6NH_2$, $-CONHCH_2CH_2NMe_2$, $-CONHCH_2CH_2CH_2O(CH_2CH_2O\rightarrow_3 CH_2CH_2CH_2NH_2$, $-CONHCH_2CF_2CF_3$, $-CONHCH_2CH_2CH_2\overset{Me}{\underset{Me}{Si}}O\overset{Me}{\underset{Me}{Si}}-Me$,

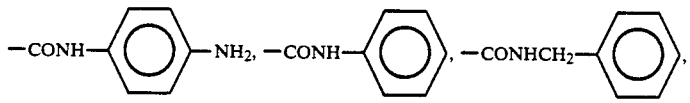

$-CONHCH_2CH_2CH_2O\leftarrow CH_2CH_2CH_2CH_2O\rightarrow_{r9}$, $-CH_2CH_2CH_2NHCO-C_lF_{2l}O\leftarrow C_nF_{2n}O\rightarrow_m A_1$,

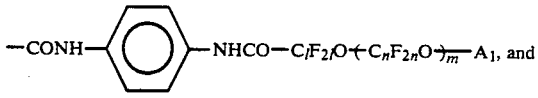

$-CONH-CH_2CH_2CH_2-\left(\overset{CH_3}{\underset{CH_3}{SiO}}\right)_{r10}\overset{CH_3}{\underset{CH_3}{Si}}-CH_2CH_2CH_2NHCO-C_lF_{2l}O\leftarrow C_nF_{2n}O\rightarrow_m A_1$.

wherein $R_9$ and $r_{10}$ each represent a positive integer, l, m and n are as defined for l, m and n of formula (I), and $A_1$ represents a monovalent group as defined for A of formula (I).

Where Y represents an aliphatic or aromatic hydrocarbon residue, that is, the group (II) is an acyl group, the carbonyl-containing group represented by formula (II) can be, for example, a group represented by the following formula (IX):

$$-\underset{\underset{O}{\|}}{C}-R_4 \qquad \text{(IX)}$$

wherein $R_4$ represents an unsubstituted or substituted aliphatic or aromatic hydrocarbon residue having from 1 to 100 carbon atoms, preferably 1 to 30 carbon atoms, more preferably from 1 to 10 carbon atoms.

Specific examples of $R_4$ include the following groups:

$-CH_3$, $-CH_2CH_3$, $-C_4H_9$, $-C_7H_{15}$, $-C_9H_{19}$,

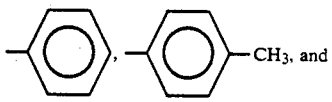

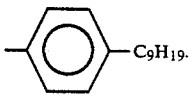

Substituents as mentioned above as the substituents of $R_1$ of formula (VII) can be mentioned as substituents of $R_4$. Examples of substituents of $R_4$ include groups (3) having up to 8 carbon atoms, mentioned above with respect to $R_1$, and groups (4) represented by formula (VII-2), mentioned above with respect to $R_1$.

A triazine ring-containing group represented by the following formula (III):

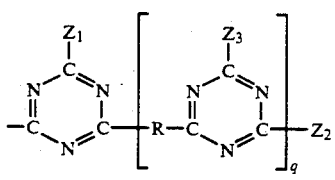

(III)

can be used as the multiple bond-containing monovalent group X.

R of formula (III) represents an unsubstituted or partially substituted bivalent perfluoropolyether residue having from 3 to 200 carbon atoms, preferably from 3 to 60 carbon atoms, an unsubstituted or partially substituted bivalent perfluoroether residue having from 2 to 60 carbon atoms, preferably from 2 to 30 carbon atoms, or an unsubstituted or partially substituted bivalent perfluorocarbon residue having from 1 to 30 carbon atoms, preferably from 1 to 15 carbon atoms.

Examples of substituents of the partially substituted residues include a halogen atom exclusive of a fluorine atom, an alkyl group, a hydrogen atom, a nitrile group, an amidine group, an imidoylamidine group, and an carbonyl-containing group, such as an ester group or an amide group. The number of substituent or substituents is not greater than 50%, preferably not greater than 30%, of the total number of fluorine atoms of each unsubstituted R.

Specific examples of R include the following groups:

$$-\overset{CF_3}{\overset{|}{C}}F\text{-}(OCF_2\overset{CF_3}{\overset{|}{C}}F)_{z1}\text{-}O\text{-}E\text{-}O\text{-}(\overset{CF_3}{\overset{|}{C}}FCF_2O)_{z2}\text{-}\overset{CF_3}{\overset{|}{C}}F-,$$

-continued $$-CF_2\text{-}(OCF_2CF_2)_{z1}\text{-}O\text{-}E\text{-}O\text{-}(CF_2CF_2O)_{z2}\text{-}CF_2-,$$

$$-CF_2O\text{-}(CF_2CF_2O)_{z1}\text{-}(CF_2O)_{z2}\text{-}CF_2-,$$

$$-CF_2O\text{-}(\overset{CF_3}{\overset{|}{C}}FCF_2O)_{z1}\text{-}(CF_2O)_{z2}\text{-}CF_2-,$$

$$-CF_2CF_2O\text{-}(CF_2CF_2CF_2O)_{z1}\text{-}CF_2CF_2-,$$

$$-CF_2CF_2-,\ \text{-}(CF_2)_4,\ \text{-}(CF_2)_5,\ \text{-}(CF_2)_6,$$

$$-CF_2-\overset{CF_3}{\overset{|}{C}}F-CF_2-, \text{ and } -CF_2CF_2-\overset{CF_3}{\overset{|}{C}}F-CF_2CF_2-.$$

In the above formulae, $z_1$ and $z_2$ represent 0 or an integer of at least 1, which is selected so that the number of carbon atoms of R is up to 200, preferably up to 100, more preferably up to 60. E represents a bivalent perfluorocarbon residue having from 1 to 15 carbon atoms, a bivalent perfluoropolyether residue having from 3 to 15 carbon atoms, or a bivalent perfluoroether residue having from 2 to 15 carbon atoms.

$Z_1$, $Z_2$ and $Z_3$ of formula (III) each independently represent an unsubstituted or partially substituted monovalent perfluoropolyether residue having from 3 to 200 carbon atoms, preferably from 3 to 60 carbon atoms, an unsubstituted or partially substituted monovalent perfluoroether residue having from 2 to 60 carbon atoms, preferably from 2 to 30 carbon atoms, or an unsubstituted or partially substituted monovalent perfluoroalkyl group having from 1 to 30 carbon atoms, preferably from 1 to 15 carbon atoms.

Examples of substituents of the partially substituted residues or group include a halogen atom exclusive of a fluorine atom, an alkyl group, a hydrogen atom, a nitrile group, an amidine group, an imidoylamidine group, and a carbonyl-containing group, such as an ester group or an amide group. The number of substituent or substituents is not greater than 50%, preferably not greater than 30%, of the total number of fluorine atoms of unsubstituted $Z_1$, $Z_2$ or $Z_3$.

Specific examples of $Z_1$, $Z_2$ and $Z_3$ include the following groups:

$$CF_3CF_2CF_2OCF_2-,\ CF_3O\overset{CF_3}{\overset{|}{C}}F-,\ CF_3OCF_2-,$$

$$CF_3CF_2CF_2O\text{-}(\overset{CF_3}{\overset{|}{C}}FCF_2O)_{s1}\text{-}\overset{CF_3}{\overset{|}{C}}F-,$$

$$CF_3O\overset{CF_3}{\overset{|}{C}}FCF_2O\overset{CF_3}{\overset{|}{C}}FCF_2O\overset{CF_3}{\overset{|}{C}}F-,\ CF_3CF_2O\text{-}(CF_2CF_2O)_{s1}\text{-}CF_2-,$$

$$(CF_3)_2CFO\text{-}(\overset{CF_3}{\overset{|}{C}}FCF_2O)_{s1}\text{-}\overset{CF_3}{\overset{|}{C}}F-,$$

$$CF_3CF_2CF_2O\text{-}(CF_2CF_2CF_2O)_{s1}\text{-}CF_2CF_2-,$$

$$CH_3OCOCF_2CF_2O\text{-}(\overset{CF_3}{\overset{|}{C}}FCF_2O)_{s1}\text{-}\overset{CF_3}{\overset{|}{C}}F-,$$

-continued $$H(CF_2)_5O\left(CF(CF_3)CF_2O\right)_{s1}CF(CF_3)-,$$

$$ICF_2CF_2O\left(CF(CF_3)CF_2O\right)_{s1}CF(CF_3)-,$$

$$NC-CF(CF_3)\left(OCF_2CF(CF_3)\right)_{s1}O-E-O\left(CF(CF_3)CF_2O\right)_{s2}CF(CF_3)-,$$

$$HN{=}C(NH_2)-CF(CF_3)\left(OCF_2CF(CF_3)\right)_{s1}O-E-O\left(CF(CF_3)CF_2O\right)_{s2}CF(CF_3)-,$$

$$ClCF_2CF_2O\left(CF(CF_3)CF_2O\right)_{s1}CF(CF_3)-,$$

$$CH_3OCOCF_2O\left(CF_2CF_2O\right)_{s1}\left(CF_2O\right)_{s2}CF_2-,$$

$$CF_3-,\ CF_3CF_2-,\ CF_3CF_2CF_2-,\ CF_3(CF_2)_6-,$$

$$Cl(CF_2CFCl)_2CF_2- \text{ and } Cl(CF_2CFCl)_3CF_2-.$$

In the above formulae, $s_1$, $s_2$ and $s_3$ represent 0 or an integer of at least 1, which is selected so that the number of carbon atoms of $Z_1$, $Z_2$ or $Z_3$ is from 1 to 200, preferably from 1 to 100, more from 1 to 60, and E represents a bivalent perfluorocarbon residue having from 1 to 15 carbon atoms, a bivalent perfluoropolyether residue having from 3 to 15 carbon atoms, or a bivalent perfluoroether residue having from 2 to 15 carbon atoms.

In formula (III), q is an integer of from 0 to 20, preferably from 0 to 10, more preferably from 0 to 5.

The compound of formula (I) used in the present invention can be easily synthesized from a compound which is represent by the same formula as formula (I), wherein substituent group X of formula (I) is, however, a carboxylic acid fluoride group (—COF) [or a group $-CF_2O^{\ominus}$ (which is in the state equilibriated with $-COF+F^{\ominus}$, having a reactivity equivalent to that of the carboxylic acid fluoride group], a carboxyl group or a lower alkyl ester group (hereinafter, frequently referred to as "precursor of compound (I)"), according to a known process.

Examples of precursors of compound (I) and examples of processes for the synthesis thereof will now be described, although the precursors and synthesis processes are not limited to those described below.

(1) Where p=1:

A precursor represented by the following formula is used:

$$R_f\left(OC_nF_{2n}\right)_m OC_lF_{2l}-COF \qquad (X)$$

wherein $R_f$ represents a perfluoroalkyl group.

Examples of compounds represented by formula (X) include an oligomer of hexafluoropropylene oxide and an oligomer of tetrafluoroethylene oxide. These compounds can be easily synthesized according to a known process.

For example, the following processes can be mentioned.

Process Disclosed in Specification of U.S. Pat. No. 3,317,484:

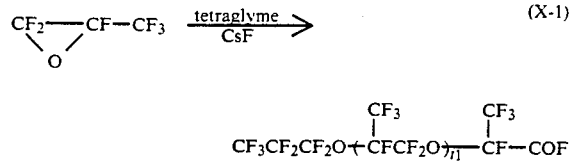

(X-1)

Process Disclosed in Specification of U.S. Pat. No. 3,419,610:

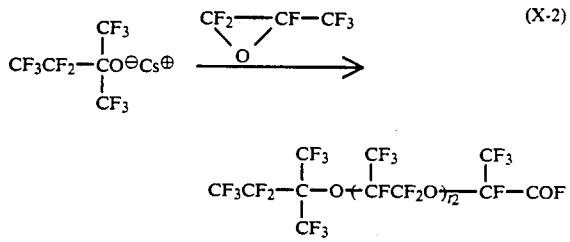

(X-2)

Process Disclosed in Journal of Macromolecular Science-Chemistry, A6(6), p. 1027 (1972):

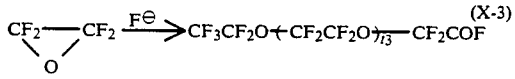

(X-3)

Process Disclosed in Specifications of U.S. Pat. No. 3,250,808 and U.S. Pat. No. 3,412,148:

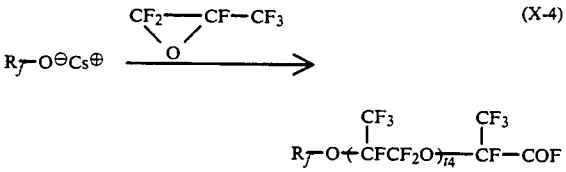

(X-4)

wherein $R_f$ represents a perfluoroalkyl group.

Process Disclosed in European patent Publication No. 0,148,482:

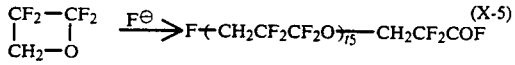

(X-5)

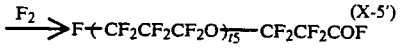

(X-5')

(2) Where p=2 or 3:

A precursor represented by the following formula is used:

$$R'_f\left(OC_nF_{2n}\right)_m OC_lF_{2l}-COF]_{2\ or\ 3} \qquad (XI)$$

wherein $R'_f$ represent a bivalent or trivalent perfluorocarbon residue.

The compound represented by formula (XI) also can be easily synthesized according to a known process.

For example, the following processes can be mentioned.

Process Disclosed in Japanese Examined Patent Publication No. 50-7054:

$$CF_2{=}CF_2 + O_2 \xrightarrow{h\nu} \xrightarrow[\text{agent}]{\text{reducing}} \xrightarrow{CH_3OH} \quad \text{(XI-1)}$$

$$CH_3O\underset{\underset{O}{\|}}{C}CF_2O\text{-}(CF_2O)_{t_{16}}\text{-}(CF_2CF_2O)_{t_{17}}\text{-}CF_2\underset{\underset{O}{\|}}{C}OCH_3$$

Process Disclosed in Specification of U.S. Pat. No. 4,113,435:

$$HO\text{-}(CH_2CH_2CH_2CH_2O)_{t_{18}}\text{-}H + F_2 \longrightarrow \quad \text{(XI-2)}$$

$$FOCC_3F_6O\text{-}(C_4F_8O)_{t_{18}}\text{-}C_3F_6COF$$

Process Disclosed in Journal of Organic Chemistry, Volume 40, p. 3271 (1975):

$$HO\text{-}(CH_2CH_2CH_2O)_{t_{19}}\text{-}H + F_2 \longrightarrow \quad \text{(XI-3)}$$

$$FOCC_2F_4O\text{-}(C_3F_6O)_{t_{19}}\text{-}C_2F_4COF$$

Process Disclosed in Specification of U.S. Pat. No. 3,250,807:

$$FOCCF_2CF_2CF_2COF + CsF \xrightarrow{CF_3-CF(\underset{O}{\diagup\diagdown})CF_2} \quad \text{(XI-4)}$$

$$(CF_2)_5\left(\begin{array}{l} O\text{-}(CF(CF_3)CF_2O)_{t_{10}}\text{-}CF(CF_3)COF \\ O\text{-}(CF(CF_3)CF_2O)_{t_{11}}\text{-}CF(CF_3)COF \end{array}\right)$$

Process Disclosed in Japanese Examined Patent Application Publication No. 53-5360:

$$FOC\text{-}CF(CF_3)OCF_2CF_2OCF(CF_3)\text{-}COF + CsF \longrightarrow \quad \text{(XI-5)}$$

$$Cs^{\oplus}\,{}^{\ominus}OCF_2CF(CF_3)OCF_2CF_2OCF(CF_3)CF_2O^{\ominus}Cs^{\oplus} \xrightarrow{CF_2(\underset{O}{\diagup\diagdown})CF-CF_3}$$

$$FOC\text{-}C(CF_3)(OCF_2CF(CF_3))_{t_{12}}\text{-}OCF_2CF_2O\text{-}(CF(CF_3)CF_2O)_{t_{13}}\text{-}CF(CF_3)\text{-}COF$$

Process Disclosed in Japanese Unexamined Patent Application Publication No. 63-265920:

$$FOC\text{-}CF_2\text{-}\underset{\underset{O}{\|}}{C}\text{-}CF_2\text{-}COF + KF \xrightarrow{CF_2(\underset{O}{\diagup\diagdown})CF-CF_3} \quad \text{(XI-6)}$$

$$\text{trifunctional oligomer} \xrightarrow[CsF]{CF_2(\underset{O}{\diagup\diagdown})CF-CF_3}$$

-continued $$\begin{array}{l} CF_2CF_2O\text{-}(CF(CF_3)CF_2O)_{t_{14}}\text{-}CF(CF_3)\text{-}COF \\ | \\ CF\text{-}O\text{-}(CF(CF_3)CF_2O)_{t_{15}}\text{-}CF(CF_3)\text{-}COF \\ | \\ CF_2CF_2O\text{-}(CF(CF_3)CF_2O)_{t_{16}}\text{-}CFCOF \end{array}$$

In formulae (X-1) through (X-5) and formulae (XI-1) through (XI-6), $t_1$ through $t_{16}$ represent 0 or a positive integer.

(3) Where a perfluoropolyether structure having a pendant functional group of formula (IV) is contained:

The units of $\text{-}(OC_nF_{2n})\text{-}$ of the compound of formula (I) used in the present invention can be substituted, in a substitution ratio of not greater than 30% based on all of these units, with unit or units represented by the following formula (IV):

$$\text{-}(CF_2\text{-}\underset{\underset{B-X'}{|}}{CF}\text{-}O)\text{-} \quad \text{(IV)}$$

wherein B represents a bivalent perfluorocarbon residue having from 1 to 15 carbon atoms, a bivalent perfluoroether residue having from 2 to 15 carbon atoms, or a bivalent perfluoropolyether residue having from 3 to 15 carbon atoms, and X' has the same meaning as defined for X of formula (I).

As examples of units of by formula (IV), there can be mentioned carbonyl group-containing units derived from groups described below, which are disclosed in Japanese Unexamined Patent Application Publication No. 57-176974 and Japanese Unexamined Patent Application Publication No. 57-176973:

$$\text{-}(CF_2\underset{\underset{CF_2OCF_2CF_2CN}{|}}{CF}\text{-}O)\text{-},$$

$$\text{-}(CF_2\underset{\underset{CF_2OCF_2CF(CF_3)OCF_2CF_2CN}{|}}{CF}\text{-}O)\text{-},$$

$$\text{-}(CF_2\underset{\underset{CF_2O\text{-}(CF_2)_4\text{-}CONH_2}{|}}{CF}\text{-}O)\text{-},$$

$$\text{-}(CF_2\underset{\underset{CF_2O\text{-}(CF_2)_4\text{-}CO_2Me}{|}}{CF}\text{-}O)\text{-},$$

and various carbonyl-containing units derived from $$\text{-}(CF_2\underset{\underset{CF_2O\text{-}(CF_2)_4\text{-}COF}{|}}{CF}\text{-}O)\text{-}.$$

When p is not smaller than 2, a plurality of the multiple bond-containing monovalent X groups may be the same or different.

The precursors of compound (I) can be synthesized according to the processes described above. The carboxylic acid fluoride group, carboxyl group or lower alkyl ester group of the precursor can be easily converted to a nitrile group, a carboxyl group, an ester group, a thioester group, an amide group or a ketone group in accordance with a known process.

Examples of this conversion reaction are described below, although employable conversion reactions are not limited to those exemplified below.

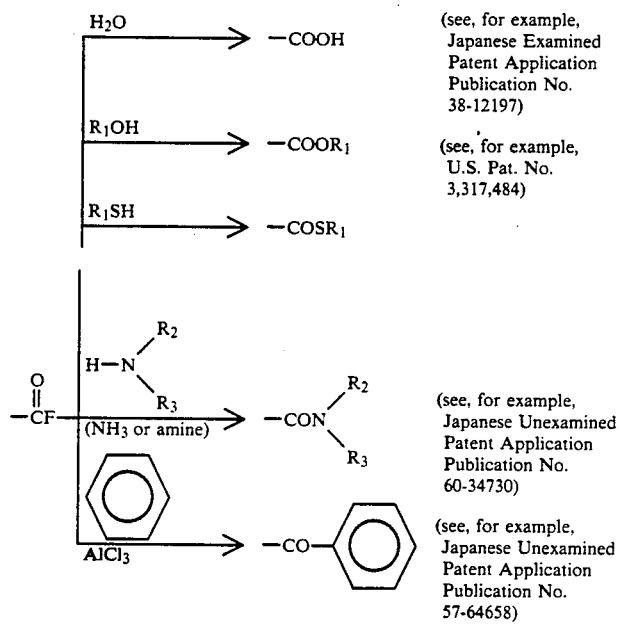

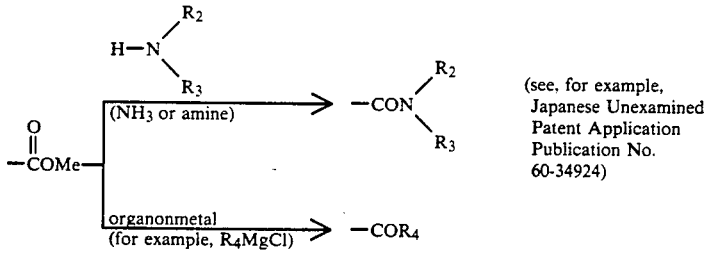

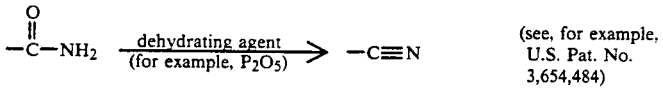

Formation of the triazine ring can be attained by treating the nitrile group according to a known process. Examples of the triazine ring-forming reaction are described below, although employable reactions are not limited to those exemplified below.

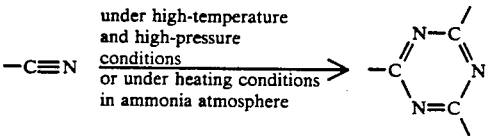

(see, for example, U.S. Pat. No. 3,654,273)

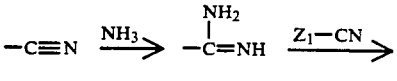

-continued

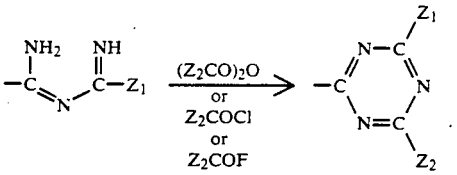

(ditto)

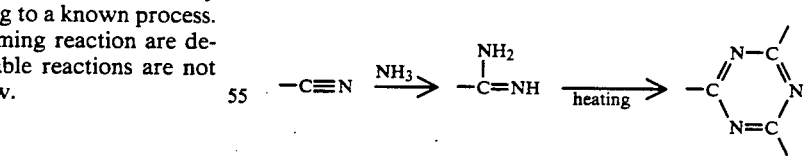

(ditto)

Compounds represented by formula (I), which may be employed used individually or i combination, can be advantageously used as a lubricant for a refrigeration system using a refrigerant comprising a tetrafluoroethane.

Moreover, the compound of formula (I) can be used in the form of a mixture thereof with at least one oil other than the compound of formula (I).

Oils employable in combination with the compound of formula (I) are not specifically limited, and can be those which are conventionally used as lubricants. For example, there can be mentioned perfluoropolyether oils, chlorofluorocarbon oils, polyalkylene glycol oils, hydrocarbon oils, ester oils, silicone oils and fluorinated silicone oils. An appropriate oil is selected among these oils, taking into consideration the miscibility with the compound of formula (I) and the viscosity or lubrication characteristics of the lubricating composition to be obtained.

When the compound of formula (I) is used in mixture with another oil or other oils, the amount of the compound of formula (I) is determined, taking into consideration the miscibility of the lubricating composition (to be obtained) with the refrigerant and the viscosity of the lubricating composition. In order to manifest a satisfactory miscibility with a tetrafluoroethane, the compound of formula (I) is used in an amount of at least 25% by weight, preferably at least 40% by weight, more preferably at least 50% by weight, based on the total weight of the lubricating composition.

When a single compound of formula (I) is used as the lubricant for a refrigerant comprising a tetrafluoroethane, it is desired that the compound of formula (I) have a kinetic viscosity of from 3 to 500 cst at 40° C. or from 5 to 500 cst at 40° C., preferably from 5 to 170 cst at 40° C., more preferably from 10 to 150 cst at 40° C.

When the viscosity is too low, satisfactory lubrication properties cannot be obtained in a compression zone. On the other hand, when the viscosity is too high, the rotation torque of the compressor disadvantageously becomes too high.

When a mixture of two or more of compounds represented by formula (I) or a mixture of the compound of formula (I) with another oil or other oils is used, the viscosity of the compound of formula (I) per se is not particularly critical, but the mixture is required to have a viscosity within the range described above with respect to the single use of the compound of formula (I).

In the present invention, the weight ratio of the total amount of the refrigerant to the total amount of the lubricant is in the range of from 99/1 to 1/99, preferably from 99/1 to 50/50, more preferably from 99/1 to 70/30.

Additives ordinarily added to lubricants, such as rust-preventive agents and extreme pressure additives, can be added, in a conventionally employed amount, to the lubricant-containing refrigerant composition for use in a refrigeration system.

The compound represented by formula (I) has a good miscibility with HFC-134*a* over a wide temperature range. For example, the lower limit temperature at which a perfluoropolyether is miscible with HFC-134*a* is generally about 0° C. or higher, except the case where the molecular weight of the perfluoropolyether is low. In contrast, with respect to the compound represented by formula (I), the lower limit temperature at which a good miscibility with HFC-134*a* is exhibited can be as low as below 0° C., and compounds of formula (I) having a lower limit temperature for this miscibility of below −10° C., preferably below −20° C., more preferably below −40° C., most preferably below −78° C. can be obtained.

Furthermore, compounds of formula (I) in which the upper limit temperature for miscibility with HFC-134*a* is above 70° C., preferably above 80° C. or more preferably above 90° C., can be easily obtained.

Accordingly, when the compound of formula (I) or a lubricating composition comprising the compound of formula (I) is used as the lubricant in a refrigerator employing a tetrafluoroethane represented by HFC-134*a*, both of the defect of a conventional perfluoropolyether lubricant, namely, too high a lower limit temperature for miscibility with HFC-134*a*, and the defect of a conventional hydrocarbon type polyglycol lubricant, namely, too low a upper limit temperature for miscibility with HFC-134*a*, can be overcome.

Moreover, it has been confirmed that the compound represented by formula (I) has not only low water absorption properties but also excellent lubrication properties, which are desired properties for a lubricant.

When the compound of formula (I) is subjected to testing for stability evaluation (which is the so-called sealed tube test) wherein the compound of formula (I) is heated in the presence of HFC-134*a* together with a metal, such as copper, brass, aluminum or carbon steel, excellent results are obtained. Namely, the compound of formula (I) is stable even at 175° C. and the surface of the metal shows substantially no change.

Accordingly, the compound represented by formula (I) or an oil comprising this compound as the main component is useful as a lubricant for various refrigeration systems using HFC-134*a* as the refrigerant, such as refrigerators, freezers and car air conditioners.

Furthermore, the compound represented by formula (I) or an oil comprising this compound as the main component is also valuable as a lubricant for a refrigerator using as the refrigerant HFC-134 (1,1,2,2-tetrafluoroethane), which is an isomer of HFC-134*a*.

Therefore, in an other aspect of the present invention, there is provided a method for imparting lubrication properties to a tetrafluoroethane refrigerant for a refrigeration equipment, which comprises adding to the refrigerant a lubricant oil selected from the group consisting of a fluorine-containing compound (I) and a lubricating composition comprising compound (I) in an amount of at least 25% by weight, based on the lubricating composition, the compound (I) being represented by the formula:

$$A[(OC_nF_{2n})_m(OC_lF_{2l})_{m'}X]_p \qquad \text{(I)}$$

wherein:

X is a multiple bond-containing monovalent group selected from the group consisting of:

(i) a carbonyl-containing group of the formula:

$$-\underset{\underset{O}{\|}}{C}-Y \qquad \text{(II)}$$

wherein Y represents a hydroxyl group, an unsubstituted or partially substituted alkoxy group having from 1 to 300 carbon atoms, an unsubstituted or partially substituted aryloxy group having from 6 to 300 carbon atoms, an unsubstituted or partially substituted alkylthio group having from 1 to 300 carbon atoms, an unsubstituted or partially substituted arylthio group having from 6 to 300 carbon atoms, an unsubstituted or partially substituted amino group having from 0 to 300 carbon atoms, an unsubstituted or partially substituted monovalent aliphatic hydrocarbon residue having from 1 to 100 carbon atoms, or an unsubstituted or partially substituted monovalent aromatic hydrocarbon residue having from 6 to 100 carbon atoms, (ii) a nitrile group and (iii) a triazine ring-containing group of the formula:

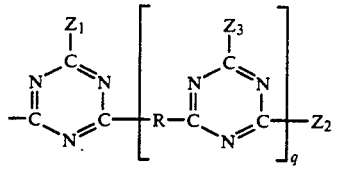

(III)

wherein R represents an unsubstituted or partially substituted bivalent perfluoropolyether residue having from 3 to 200 carbon atoms, an unsubstituted or partially substituted bivalent perfluoroether residue having from 2 to 60 carbon atoms, an unsubstituted or partially substituted bivalent perfluorocarbon residue having from 1 to 30 carbon atoms; $Z_1$, $Z_2$ and $Z_3$ each independently represent an unsubstituted or partially substituted monovalent perfluoropolyether having from 3 to 200 carbon atoms, an unsubstituted or partially substituted monovalent perfluoroether residue having from 2 to 60 carbon atoms, or an unsubstituted or partially substituted monovalent perfluoroalkyl group having from 1 to 30 carbon atoms, and q is an integer of from 0 to 20;

p is an integer of from 1 to 3;

A represents an unsubstituted or partially substituted mono-, bi- or trivalent perfluorocarbon residue having from 1 to 15 carbon atoms, or an unsubstituted or partially substituted mono-, bi- or trivalent perfluoroether residue having from 2 to 15 carbon atoms, or an unsubstituted or partially substituted mono-, bi- or trivalent perfluoropolyether having from 3 to 15 carbon atoms;

l is an integer of from 1 to 3;

m is an integer of from 0 to 80;

m' is 0 or 1; and n is an integer of from 1 to 4;

wherein when p and/or m is not smaller than 2, the units of $-(OC_nF_{2n})-$ are the same or different and are not replaced or are replaced with a unit or units of the formula:

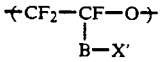

(IV)

wherein B represents a bivalent perfluorocarbon residue having from 1 to 15 carbon atoms, a bivalent perfluoroether residue having from 2 to 15 carbon atoms, or a bivalent perfluoropolyether residue having from 3 to 15 carbon atoms, and X' has the same meaning as defined for X of formula (I), with the proviso that the number of unit or units of $-OC_nF_{2n}$ replaced by a unit or units of the formula (IV) is not greater than 30% of the total number of the units of of $-(OC_nF_{2n})-$; and wherein when p is not smaller than 2, the multiple bond-containing monovalent X groups are the same or different.

The compound represented by formula (I) or an oil containing at least 25% by weight of this compound can also be used as a lubricant for a refrigeration system using as a refrigerant a mixture of a tetrafluoroethane and other fluoro-compound, such as a trifluoroethane (e.g., 1,1,1-trifluoroethane), for example, a mixture containing at least 20 mole %, preferably at least 40 mole %, of a tetrafluoroethane.

BEST MODE FOR CARRYING OUT THE INVENTION

The present invention will now be described in detail with reference to the following examples that by no means limit the scope of the invention.

The number average molecular weight ($\overline{MW}n$) of the compound of formula (I) can be easily determined from $^{19}$F-NMR spectrum or $^{1}$H-NMR spectrum according to the process disclosed in Journal of Macromolecular Science-Chemistry, A8(3), p. 499 (1974) or an analogous process. When the compound of formula (I) is synthesized by linking a plurality of substances respectively having known number average molecular weights, the number average molecular weight of the compound of formula (I) can be easily calculated from the number average molecular weights of the starting substances.

The kinetic viscosity of the lubricant of the present invention can be determined by measuring the viscosity by means of a viscometer. As the viscometer to be used for determining the kinetic viscosity, there can be mentioned a capillary viscometer, such as a Ubbellohde viscometer, an Ostward viscometer or a Cannon-Fenske viscometer, a rotational viscometer, and a falling ball viscometer.

REFERENTIAL EXAMPLE 1

(1) In substantially the same manner as in the process for the polymerization of hexafluoropropylene oxide, disclosed in Japanese Examined Patent Publication No. 53-5360, as in the process for the purification of hexafluoropropylene oxide, disclosed in Japanese Unexamine Patent Publication No. 57-175185, and as in the process for the conversion of polymer terminals, disclosed in the specification of U.S. Pat. No. 3,317,484, hexafluoropropylene oxide was polymerized by using a polymerization initiator of the following formula:

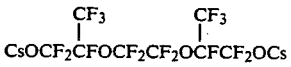

to obtain $R_{fo}(CF_2OCs)_2$ having a number average molecular weight of about 1,500, in which $R_{of}$ represents a perfluoropolyether portion of formula (XI-5), which is represented by the following formula:

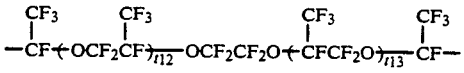

(2) $R_{fo}(CF_2OCs)_2$ obtained in (1) above was reacted with methanol to obtain $R_{fo}(COOCH_3)_2$ exhibiting an absorption peak at 1795 cm$^{-1}$ in the infrared absorption spectrum and having number average molecular weight of about 1,500.

REFERENTIAL EXAMPLE 2

$R_{fo}(COOCH_3)_2$ having a number average molecular weight of 1,500 was contacted with ammonia gas, and the obtained terminal-amidated compound was heated with phosphorus pentoxide to obtain $R_{fo}(CN)_2$ exhibiting an absorption ascribed to the nitrile group at 2260

$cm^{-1}$ in the infrared absorption spectrum and having a number average molecular weight of about 1,500.

REFERENTIAL EXAMPLE 3

$R_{fo}(COOCH_3)_2$ having a number average molecular weight of 1,500 was reacted with dibutylamine to obtain $R_{fo}[CON(Bu)_2]_2$ exhibiting an absorption peak at 1682 $cm^{-1}$ in the infrared absorption spectrum and having a number average molecular weight of 1,500.

REFERENTIAL EXAMPLE 4

Hexafluoropropylene oxide was polymerized by using potassium fluoride as a polymerization initiator to obtain an oligomer of hexafluoropropylene oxide, and a trimer was isolated therefrom by distillation. The trimer was reacted with methanol to obtain $R'_{fo}$—COOMe. The obtained product was reacted with ammonia gas to obtain $R'_{fo}$—$CONH_2$ exhibiting an absorption peak at 1738 $cm^{-1}$ in the infrared absorption spectrum and having a number average molecular weight of 495.

REFERENTIAL EXAMPLE 5

By substantially the same process as disclosed in the specification of Canadian Patent No. 960,222, substances of the following formulae were synthesized:

$$NC-CF_2O(CF_2CF_2O)_{t17}(CF_2O)_{t18}-CF_2CN,$$

(the number average molecular weight is about 1,600

$$CF_3CF_2CF_2OCF(CF_3)CF_2OCF(CF_3)C(=O)-O-CH_2CH_2OCH_2CH_2CH_2O-\left(\begin{matrix}CH_3\\|\\SiO\\|\\CH_3\end{matrix}\right)_{t22}\begin{matrix}CH_3\\|\\Si\\|\\CH_3\end{matrix}-O-CH_2CH_2CH_2OCH_2CH_2OC(=O)-CF(CF_3)OCF_2CF(CF_3)OCF_2CF_2CF_3.$$

and $t_{17}$ and $t_{18}$ each represent a positive integer) and $$MeO_2C-CF_2O(CF_2CF_2O)_{t19}(CF_2O)_{t20}-CF_2CO_2Me,$$

(the number average molecular weight is about 1,670 and $t_{19}$ and t20 each represent a positive integer).

The above dinitrile and dimethyl ester will frequently be referred to simply as "$R''_{fo}(CN)_2$" and "$R''_{fo}(COOMe)_2$", respectively, hereinafter.

REFERENTIAL EXAMPLE 6

In 700 g of 1,1,2-trichloro-1,2,2-trifluoroethane (frequently abbreviated as "F-113") was dissolved 150 g of polyoxypropylene glycol (supplied by Wako Junyaku, Japan; the number average molecular weight is 1,000), and 200 g of a trimer of hexafluoropropylene oxide of the following formula:

$$CF_3CF_2CF_2OCF(CF_3)CF_2OCF(CF_3)COF$$

and 50 g of pyridine were then added. Reaction was performed at room temperature for 15 hours. After the reaction, F-113 and the excessive hexafluoropropylene oxide trimer were removed by an evaporator. Then, F-113 was added to the residue again to form a solution. The solution was washed with distilled water two times, and the F-113 layer was recovered. Removal of the F-113 by means of an evaporator gave 295 g of a compound exhibiting a characteristic absorption at 1782 $cm^{-1}$ in the infrared absorption spectrum and having the following structural formula (the number average molecular weight is 2,000):

$$CF_3CF_2CF_2OCF(CF_3)CF_2OCF(CF_3)-C(=O)-O(CH(CH_3)CH_2O)_{t21}(C(=CF_3)F)CFOCF_2CF(CF_3)O-CF_2CF_2CF_3$$

REFERENTIAL EXAMPLE 7

Substantially the same procedure as in Referential Example 6 was repeated except that a silicone compound of the following formula (the number average molecular weight was 1,000):

$$HO-CH_2CH_2OCH_2CH_2CH_2O-\left(\begin{matrix}CH_3\\|\\SiO\\|\\CH_3\end{matrix}\right)_{t22}\begin{matrix}CH_3\\|\\Si\\|\\CH_3\end{matrix}-OCH_2CH_2CH_2OCH_2CH_2OH$$

was used instead of the polyoxypropylene glycol, to thereby obtain a compound of the following formula (the number average molecular weight is 2,000):

REFERENTIAL EXAMPLE 8

Substantially the same procedure as in Referential Example 6 was repeated except that bisphenol A of the following formula:

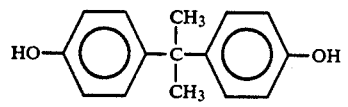

was used instead of the polyoxypropylene glycol, to thereby obtain a compound of the following formula:

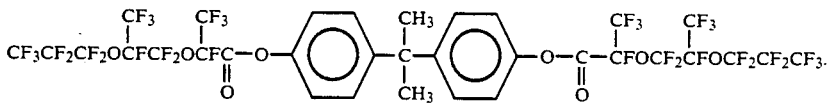

REFERENTIAL EXAMPLE 9

The terminal acid fluoride group of a trimer of hexafluoropropylene oxide, represented by the following formula:

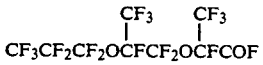

was converted to a nitrile group via an amide group according to a customary procedure, and 47.7 g of the obtained compound of the following formula:

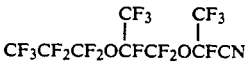

was heated at 100° C. in an ammonia atmosphere for 12 hours and then heated at 220° C. for 24 hours. After the reaction, ammonia was removed under reduced pressure to obtain 45 g of a compound (the boiling point was 121° C. under 0.11 mmHg) exhibiting an absorption peak ascribed to the triazine ring at 1556 $cm^{-1}$ in the infrared absorption spectrum, which is represented by the following formula:

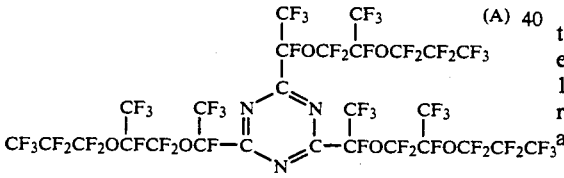

(A)

REFERENTIAL EXAMPLE 10

At −30° C., 30 g of $R_{fo}(CN)_2$ having a number average molecular weight of 1,500 was contacted with liquid ammonia to obtain a reaction product comprised mainly of a diamidine of the following formula:

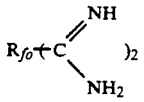

Then, 20 g of the reaction product was reacted with a compound of the following formula:

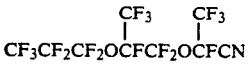

at 40° C. for 12 hours. The excessive amount of the compound of the following formula:

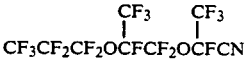

was removed under reduced pressure to obtain a reaction product comprised mainly of a diimidoylamidine compound exhibiting characteristic absorptions ascribed to the imidoylamidine groups at 1654, 1604 and 1520 $cm^{-1}$ in the infrared absorption spectrum, which is represented by the following formula:

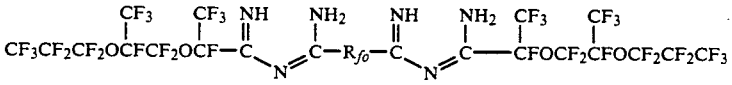

Then, 30 g of this imidoylamidine was reacted at 40° C. with 30 g of a trimer of hexafluoropropylene oxide represented by the following formula:

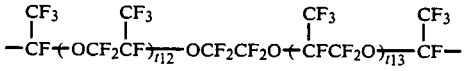

to effect ring closure reaction and obtain a compound exhibiting an absorption ascribed to the triazine ring at 1556 $cm^{-1}$ in the infrared absorption spectrum, which is represented by the following formula (the number average molecular weight is 3,500):

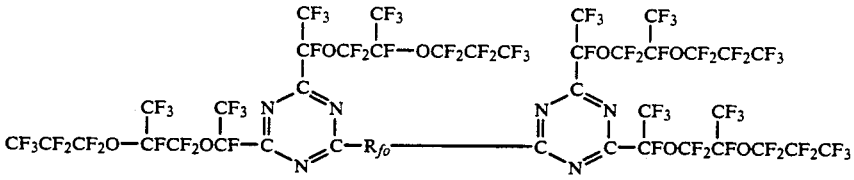

This compound (C) was distilled at a temperature of 220 to 260° C. under a pressure of 0.05 mmHg in a film distillation apparatus.

REFERENTIAL EXAMPLE 11

In an ammonia atmosphere, 23 g of dinitrile $R_{fo}(CN)_2$ having a number average molecular weight of 1,500 and 77 g of a compound of the following formula:

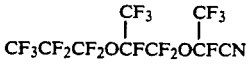

were heated at 100° C. for 24 hours and then at 240° C. for 100 hours. After the reaction, ammonia was removed under reduced pressure, and the residue was purified by means of a silica gel column by using perfluorohexane as a solvent. The solvent was removed under reduced pressure. Then, distillation under reduced pressure was performed to remove 43 g of a fraction (having a boiling point of 132° C. under 0.13 mmHg) composed mainly of a compound of the following formula:

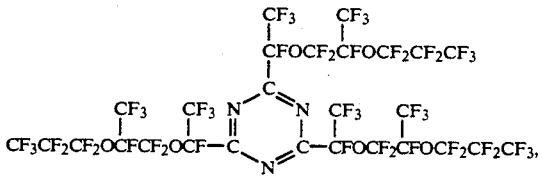

to thereby obtain 46 g of an oil having a kinetic viscosity of 81 cst at 40° C., which was composed mainly of a compound of the following formula:

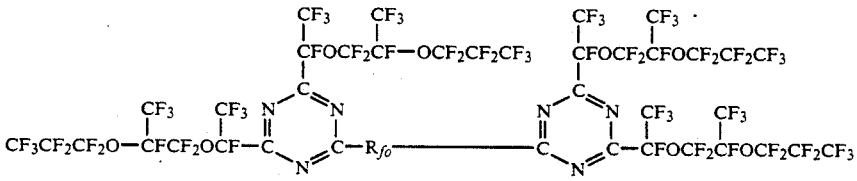

EXAMPLE 1

A glass tube was charged with 0.5 g of $R_{fo}(COOMe)_2$ (having a number average molecular weight of about 1,500 and a kinetic viscosity of 10 cst at 40° C.) synthesized according to the process of Referential Example 1. The glass tube was cooled by liquid nitrogen. The internal pressure of the glass tube was reduced and, about 1.5 g of HFC-134a was introduced into the glass tube. The glass tube was sealed and placed in a temperature-adjusted water tank. When the temperature was equilibriated, the temperature range for $R_{fo}(COOMe)_2$'s being miscible with HFC-134*a* was measured according to the method in which the miscibility of $R_{fo}(COOMe)_2$ with HFC-134*a* was judged with the naked eye. The miscibility at temperatures lower than room temperature was likewise measured while cooling the sample with methanol as a cooling medium.

As the result, it was found that the lower limit temperature for $R_{fo}(COOMe)_2$ to be miscible with HFC-134*a* was below −78° C. and the upper limit temperature for being miscible with HFC-134*a* was above 90° C.

EXAMPLES 2 THROUGH 31

With respect to each of the compounds of formula (I) synthesized by substantially the same methods as described in Referential Examples 1 through 11, the miscibility with HFC-134*a* was examined in the same manner as described in Example 1. The obtained results are shown in Table 1 together with data of the kinetic viscosity at 40° C.

EXAMPLES 32 THROUGH 45

With respect to various compounds of formula (I) and mixtures of these compounds with a perfluoropolyether oil, the miscibility with HFC-134*a* was examined at −50° C., −10° C. and 90° C.

The obtained results are shown in Table 2.

COMPARATIVE EXAMPLES 1 THROUGH 9

The miscibility of commercially available perfluoropolyethers and various polyalkylene glycols with HFC-134*a* was examined in the same manner as described in Example 1. The obtained results are shown in Tables 3 and 4 together with data of the kinetic viscosity at 40° C.

In Tables 1 through 10, $\overline{M}n$ means the number average molecular weight, and n and $m_1$ through $m_6$ each represent a positive integer.

TABLE 1

| Example No. | Structural formula | $\overline{Mn}$ | Kinetic viscosity (cst, 40° C.) | Temperature range for being miscible with HFC-134a: lower limit temperature | Temperature range for being miscible with HFC-134a: upper limit temperature |
|---|---|---|---|---|---|
| 1 | $R_{fo}(COOMe)_2$ | 1,500 | 10 | below −78° C. | above 90° C. |
| 2 | " | 2,000 | 21 | below −78° C. | above 90° C. |
| 3 | " | 5,000 | 125 | −20° C. | above 90° C. |
| 4 | $R_{fo}(CN)_2$ | 1,500 | 10 | below −78° C. | above 90° C. |
| 5 | " | 4,000 | 66 | −20° C. | above 90° C. |
| 6 | $R_{fo}[COO(CH_2CH_2O)_2CH_3]_2$ | 1,500 | 10 | below −78° C. | above 90° C. |
| 7 | $R_{fo}[CON(Bu)_2]_2$ | 1,500 | 70 | below −78° C. | above 90° C. |
| 8 | $R_{fo}(CONH_2)_2$ | 1,000 | 387 | −20° C. | above 90° C. |
| 9 | $R'_{fo}—CON(Bu)_2$ | 2,500 | 61 | −30° C. | above 90° C. |
| 10 | $CF_3CF_2CF_2OCF(CF_3)CF_2OCF(CF_3)—C(=O)—O—[CH(CH_3)CH_2O]_n—C(=O)—CF(CF_3)OCF_2CF(CF_3)OCF_2CF_2CF_3$ | 2,000 | 52 | below −78° C. | above 90° C. |
| 11 | " | 3,000 | 134 | below −78° C. | 85° C. |
| 12 | $CF_3CF_2CF_2OCF(CF_3)—C(=O)O—[CH(CH_3)CH_2O]_n—C(=O)—CF(CF_3)OCF_2CF_2CF_3$ | 1,700 | 41 | below −78° C. | above 90° C. |
| 13 | " | 2,700 | 110 | below −78° C. | 83° C. |
| 14 | $CF_3C(=O)—O—[CH(CH_3)CH_2O]_n—C(=O)CF_3$ | 1,200 | 40 | below −78° C. | above 90° C. |
| 15 | $CF_3CF_2CF_2OCF(CF_3)CF_2OCF(CF_3)—C(=O)O—(CH_2CH_2CH_2CH_2O)_n—C(=O)—CF(CF_3)OCF_2CF(CF_3)OCF_2CF_2CF_3$ | 1,600 | 50 | −10° C. | above 90° C. |

TABLE 1-continued

| Example No. | Structural formula | $\overline{Mn}$ | Kinetic viscosity (cst, 40° C.) | Temperature range for being miscible with HFC-134a: lower limit temperature | Temperature range for being miscible with HFC-134a: upper limit temperature |
|---|---|---|---|---|---|
| 16 | $CF_3CF_2CF_2OCF(CF_3)-C(=O)-O-(CH_2CH_2CH_2CH_2O)_n-C(=O)-CF(CF_3)OCF_2CF_2CF_3$ | 1,300 | 43 | −10° C. | above 90° C. |
| 17 | $CF_3CF_2CF_2OCF(CF_3)-C(=O)NH-CH_2CH_2CH_2O-(CH_2CH_2CH_2CH_2O)_n-CH_2CH_2CH_2NHC(=O)-CF(CF_3)-OCF_2CF(CF_3)OCF_2CF_2CF_3$ | 1,700 | 257 | −3° C. | above 90° C. |
| 18 | $CF_3CF_2CF_2OCF(CF_3)CF_2OCF(CF_3)-C(=O)O-(CH_2CH_2O)_n-OC(=O)-CF(CF_3)OCF_2CF(CF_3)OCF_2CF_2CF_3$ | 2,000 | 82 | below −78° C. | above 90° C. |
| 19 | $CF_3CF_2CF_2OCF(CF_3)CF_2OCF(CF_3)-C(=O)O-(CH_2)_{12}-OC(=O)-CF(CF_3)OCF_2CF(CF_3)OCF_2CF_2CF_3$ | 1,160 | 15 | below −78° C. | above 90° C. |
| 20 | $CH_3CH_2C[CH_2OC(=O)-CF(CF_3)OCF_2CF(CF_3)OCF_2CF_2CF_3]_3$ | 1,570 | 30 | below −78° C. | above 90° C. |
| 21 | $CF_3CF_2CF_2OCF(CF_3)CF_2OCF(CF_3)-C(=O)-O-CH_2CH_2OCH_2CH_2CH_2-[Si(CH_3)_2-O]_n-Si(CH_3)_2-CH_2CH_2CH_3OCH_2CH_2OC(OCF_3)=CF(CF_3)OCF_2CF(CF_3)OCF_2CF_2CF_3$ | 2,000 | 9 | below −78° C. | above 90° C. |
| 22 | $C_9H_{19}-C_6H_4-OC(=O)CF_3$ | 316 | 6 | −70° C. | above 90° C. |

TABLE 1-continued
| Example No. | Structural formula | $\overline{Mn}$ | Kinetic viscosity (cst, 40° C.) | Temperature range for being miscible with HFC-134a: lower limit temperature | Temperature range for being miscible with HFC-134a: upper limit temperature |
|---|---|---|---|---|---|
| 23 | 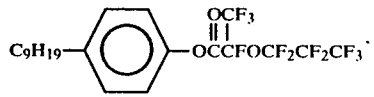 | 532 | 11 | −45° C. | above 90° C. |
| 24 | 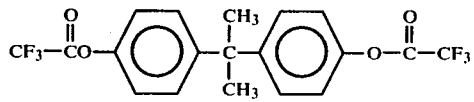 | 420 | 39 | below −78° C. | above 90° C. |
| 25 | 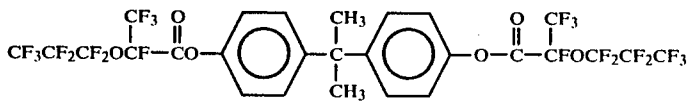 | 852 | 61 | below −78° C. | above 90° C. |
| 26 | 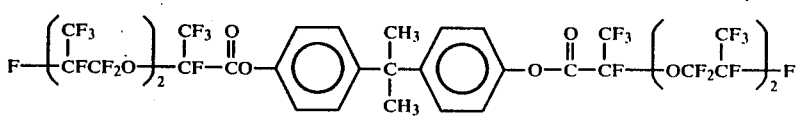 | 1,184 | 81 | below −78° C. | above 90° C. |
| 27 | 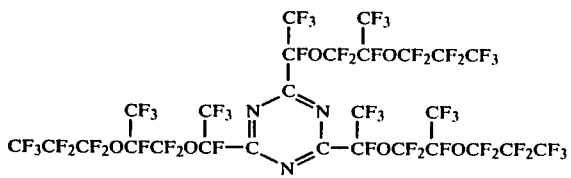 | | 9 | −75° C. | above 90° C. |
| 28 | 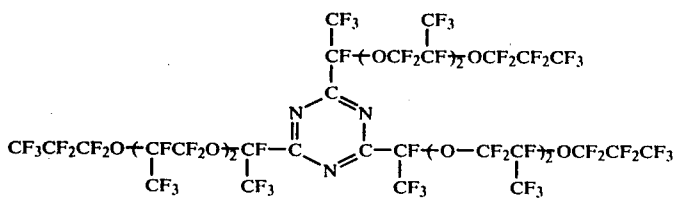 | | 24 | −42° C. | above 90° C. |

TABLE 1-continued
| Example No. | Structural formula | $\overline{Mn}$ | Kinetic viscosity (cst, 40° C.) | Temperature range for being miscible with HFC-134a: lower limit temperature | Temperature range for being miscible with HFC-134a: upper limit temperature |
|---|---|---|---|---|---|
| 29 | 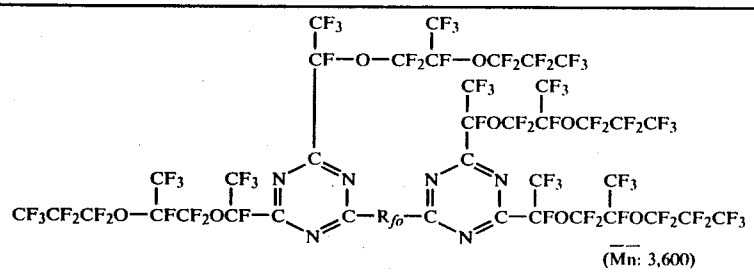 | | 83 | −35° C. | above 90° C. |
| 30 | $R_{fo}(COOH)_2$ | ($\overline{Mn}$: 1,500) | 354 | −7° C. | above 90° C. |
| 31 | $R_{fo}(COSBu)_2$ | ($\overline{Mn}$: 2,100) | 24 | below −78° C. | above 90° C. |
Note:
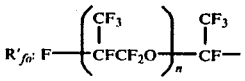

TABLE 2

| Example No. | Structural Formula | Kinetic viscosity (cst, 40° C.) | Miscibility with HFC-134a −50° C. | −10° C. | 90° C. |
|---|---|---|---|---|---|
| 32 | $CF_3(CF_2)_6C(=O)-O-[CH(CH_3)CH_2O]_n-C(=O)(CF_2)_6CF_3$ | 59 | ○ | ○ | ○ |
| 33 | $CF_3CF_2CF_2C(=O)-O-[CH(CH_3)CH_2O]_n-C(=O)CF_2CF_2CF_3$ | 42 | ○ | ○ | ○ |
| 34 | $NC-R_{fo}-[C_3N_3(CF(CF_3)OCF_2CF(CF_3)OCF_2CF_3)_2-R_{fo}]_n-CN$ (n ≈ 2) ($\overline{Mn}$: 4,150) | 120 | X | ○ | ○ |
| 35 | $CF_3CF_2CF_2OCF(CF_3)CF_2O-CF(CF_3)-C_3N_3(CF_2O(CF_2CF_2O)_{z1}(CF_2O)_{z2}CF_2-C_3N_3(CF(CF_3)OCF_2CF(CF_3)OCF_2CF_2CF_3)_2)-CF(CF_3)OCF_2CF(CF_3)OCF_2CF_2CF_3$ | 40 | X | ○ | ○ |
| 36 | $CF_3CF_2CF_2OCF(CF_3)CF_2O-CF(CF_3)-C_3N_3(CF_2CF_2CF_2CF_2-C_3N_3(CF(CF_3)OCF_2CF(CF_3)OCF_2CF_2CF_3)_2)-CF(CF_3)OCF_2CF(CF_3)OCF_2CF_2CF_3$ | 28 | X | ○ | ○ |

TABLE 2-continued

| Example No. | Structural Formula | Kinetic viscosity (cst, 40° C.) | Miscibility with HFC-134a −50° C. | −10° C. | 90° C. |
|---|---|---|---|---|---|
| 37 | 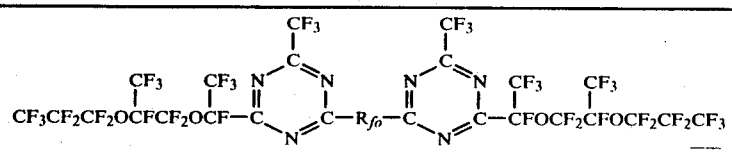 ($\overline{Mn}$: 2,700) | 46 | X | ○ | ○ |
| 38 | $R'_{fo}$—$CONH_2$ | 23 | X | ○ | ○ |
| 39 | $R''_{fo}(CN)_2$ | 10 | ○ | ○ | ○ |
| 40 | $R''_{fo}(COOMe)_2$ | 13 | ○ | ○ | ○ |
| 41 | 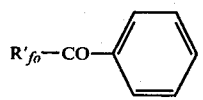 | 18 | ○ | ○ | ○ |
| 42 | $R_{fo}(COOMe)_2$ | 19 | ○ | ○ | ○ |
| 43 | $R_{fo}(CN)_2$ | 40 | X | ○ | ○ |
| 44 | $R_{fo}(COOMe)_2$ ($\overline{Mn}$: 1,500) + Demnum ® S-20 *1 [weight ratio = 0.6:0.4] | 14 | X | ○ | ○ |
| 45 | $R'_{fo}$—COOMe ($\overline{Mn}$: 1,500) + Demnum ® S-20 *1 [weight ratio = 0.5:0.5] | 15 | X | ○ | ○ |

Note:
○: miscible
X: phase separation
*1: $F\text{-}(CF_2CF_2CF_2O)_{m2}\text{-}CF_2CF_3$ supplied by Daikin Kogyo, Japan

TABLE 3

| Comparative Example No. | Lubricant | $\overline{Mn}$ | Kinetic viscosity (cst, 40° C.) | Temperature range for being miscible with HFC-134a: lower limit temperature | upper limit temperature |
|---|---|---|---|---|---|
| 1 | KRYTOX ® 143AY *2 | 3,000 | 50 | 5° C. | above 90° C. |
| 2 | KRYTOX ® 143AX *2 | 4,800 | 134 | 25° C. | above 90° C. |
| 3 | DEMNUM ® S-20 *1 | 2,700 | 25 | −5° C. | above 90° C. |
| 4 | FOMBLIN ® M-03 *3 | 4,000 | 17 | −5° C. | above 90° C. |
| 5 | FOMBLIN ® Y-06 *4 | 1,800 | 27 | −5° C. | above 90° C. |

Note:

*1: $F\text{-}(CF_2CF_2CF_2O)_{m2}\text{-}CF_2CF_3$ supplied by Daikin Kogyo, Japan

*2: $F\text{-}(CF(CF_3)CF_2O)_{m1}\text{-}CF_2CF_3$ supplied by Du Pont, USA

*3: $CF_3O\text{-}(CF_2CF_2O)_{m5}\text{-}(CF_2O)_{m6}\text{-}CF_3$ supplied by Montefluos, Italy

*4: $CF_3O\text{-}(CF(CF_3)CF_2O)_{m3}\text{-}(CF_2O)_{m4}\text{-}CF_3$ supplied by Montefluos, Italy

TABLE 4

| Comparative Example No. | Structural formula | $\overline{Mn}$ | Kinetic viscosity (cst, 40° C.) | Temperature range for being miscible with HFC-134a: lower limit temperature | upper limit temperature |
|---|---|---|---|---|---|
| 6 | $HO\text{-}(CH(CH_3)CH_2O)_n\text{-}H$ | 2,000 | 171 | −60° C. | 0° C. |
| 7 | " | 1,000 | 82 | −78° C. | 62° C. |
| 8 | $HO\text{-}(CH_2CH_2CH_2CH_2O)_n\text{-}H$ | 650 | 134 | (not miscible at 20° C.) | |
| 9 | $HO\text{-}(CH_2CH_2O)_n\text{-}H$ | 1,000 | 96 | (not miscible at 20° C.) | |

EXAMPLES 46 THROUGH 49

Evaluation of Heat Resistance (Sealed Tube Test)

A glass tube was charged with 0.6 ml of $R_{fo}(COOMe)_2$ (number average molecular weight=2,000) purified by means of a silica gel column, HFC-134*a* and test pieces of iron, copper and aluminum, and the glass tube was then sealed to obtain a test sample. The test sample was heated at 175° C. for 10 days. After the heating, any change of the hue of the test sample and any change of the surfaces of the metal pieces were examined. It was found that the hue of the test sample and the surfaces of the metals were not changed. Furthermore, the viscosity and infrared absorption spectrum of $R_{fo}(COOMe)_2$ were not changed.

The heat resistances of various compounds of the present invention were evaluated according to the sealed tube test in the same manner as described above. The obtained results are shown in Table 5. It was found that the compounds of the present invention have a satisfactorily high heat resistance.

TABLE 5

| Example No. | Structural formula | After sealed tube test: hue | viscosity | IR | metal surface |
|---|---|---|---|---|---|
| 46 | $R_{fo}(COOMe)_2$ ($\overline{Mn}$: 2,000) | not changed | not changed | not changed | not changed |
| 47 | $R'_{fo}\text{-}COOMe$ ($\overline{Mn}$: 1,500) | not changed | not changed | not changed | not changed |
| 48 | 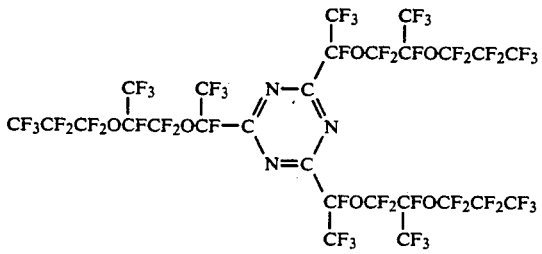 | not changed | not changed | not changed | not changed |

TABLE 5-continued

| Example No. | Structural formula | After sealed tube test: hue | viscosity | IR | metal surface |
|---|---|---|---|---|---|
| 49 | 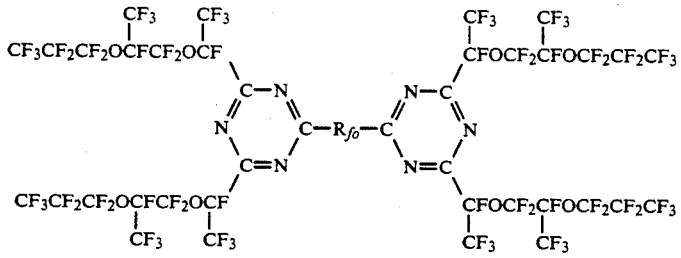 ($\overline{Mn}$: 3,500) | not changed | not changed | not changed | not changed |

EXAMPLES 50 THROUGH 54

Lubrication Test (Falex Test)

Use was made of a Falex tester. Under conditions such that the oil temperature at the start of the testing was adjusted at 20° C. and a load of 300 pounds was applied, the tester was driven for 3 minutes. While increasing the load, 100 pounds by 100 pounds, the tester was driven for 1 minute under each load until seizing was caused. The measurement of the seizing loads of various compounds of the present invention was conducted. The results are shown in Table 6. It was found that each of the compounds has excellent lubrication properties.

COMPARATIVE EXAMPLES 10 THROUGH 13

The seizing loads of commercially available perfluoropolyether oils, polyoxyalkylene glycols and mineral oils were measured in the same manner as described in Example 50. The obtained results are shown in Table 7.

TABLE 6

| Example No. | Structural formula | Kinetic viscosity (cst, 40° C.) | Seizing load (pounds) |
|---|---|---|---|
| 50 | $R_{fo}(COOMe)_2$ ($\overline{Mn}$: 5,000) | 125 | above 1,500 |
| 51 | $R'_{fo}$—COOMe ($\overline{Mn}$: 1,500) | 10 | above 1,500 |
| 52 | 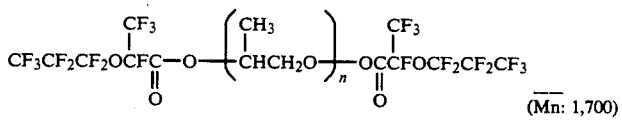 ($\overline{Mn}$: 1,700) | 41 | 700 |
| 53 | 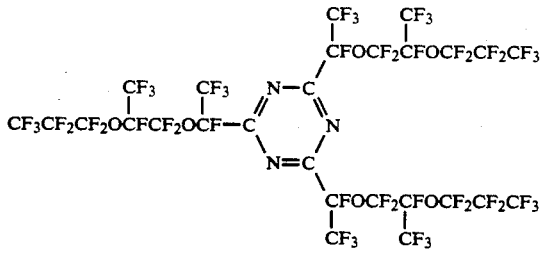 | 9 | above 1,500 |
| 54 | 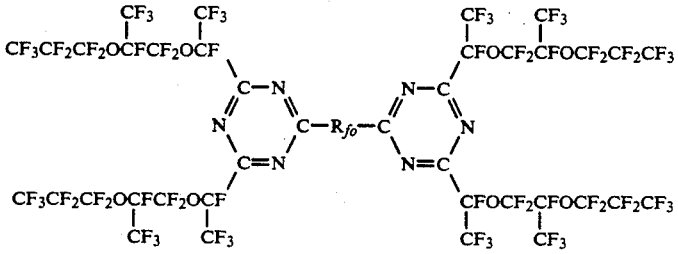 ($\overline{Mn}$: 3,500) | 83 | 1,300 |

TABLE 7

| Comparative Example No. | Lubricant | Kinetic viscosity (cst, 40° C.) | Seizing load (pounds) |
|---|---|---|---|
| 10 | DEMNUM ® S-65 *5 | 65 | above 1,500 |
| 11 | $H-\left(O-CH_2\overset{CH_3}{\overset{\mid}{C}}H\right)_n-OH$ ($\overline{Mn}$: 1,000) | 73 | 700 |
| 12 | SUNISO ® 3GS *6 | 30 | 500 |
| 13 | SUNISO ® 5GS *7 | 97 | 400 |

Note:

*5: $F-(CF_2CF_2CF_2O)_{m2}-CF_2CF_3$ supplied by Daikin Kogyo, Japan

*6: naphthene type mineral oil supplied by Nippon San Sekiyu, Japan

*7: naphthene type mineral oil supplied by Nippon San Sekiyu, Japan

EXAMPLES 55 AND 56 AND COMPARATIVE EXAMPLES 14 AND 15

Breakdown Voltage

According to the method of JIS C2101 (test method for electrically insulating oils), the breakdown voltages of various compounds of the present invention and polypropylene glycols were measured. The obtained results are shown in Table 8. It was found that each of the compounds of the present invention has a satisfactorily high breakdown voltage.

TABLE 8

| | Lubricant | Kinetic viscosity (cst, 40° C.) | Breakdown voltage |
|---|---|---|---|
| Example No. | | | |
| 55 | $R'_{fo}-COOMe$ | 10 | above 60 kV |
| 56 | 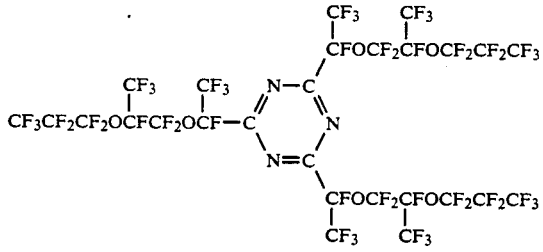 | 9 | above 60 kV |
| Comparative Example No. 14 | $H-\left(OCH_2\overset{CH_3}{\overset{\mid}{C}}H\right)_n-OH$ ($\overline{Mn}$: 400) | 30 | 47 kV |
| 15 | SUNISO ® 3GS *6 | 30 | 54 kV |

Note:

*6: naphthene type mineral oil supplied by Nippon San Sekiyu, Japan

EXAMPLES 57 THROUGH 59 AND COMPARATIVE EXAMPLES 16 AND 17

Water Absorption Properties

Various compounds of the present invention, polypropylene glycols and mineral oils were allowed to stand in a constant-temperature and constant-humidity vessel maintained at a temperature of 40° C. and at a relative humidity of 80%, and the equilibrium water absorptions were measured. The obtained results are shown in Table 9. It was found that the compound of formula (I) according to the present invention has low water absorbing properties and is suitable as a lubricant.

TABLE 9

| | Lubricant | Equilibriated water absorption |
|---|---|---|
| Example No. | | |
| 57 | $R_{fo}(CN)_2$ ($\overline{Mn}$: 4,000) | lower than 50 ppm |
| 58 | $R_{fo}(COOMe)_2$ (Mn: 5,000) | lower than 50 ppm |

TABLE 9-continued

| | Lubricant | Equilibriated water absorption |
|---|---|---|
| 59 | 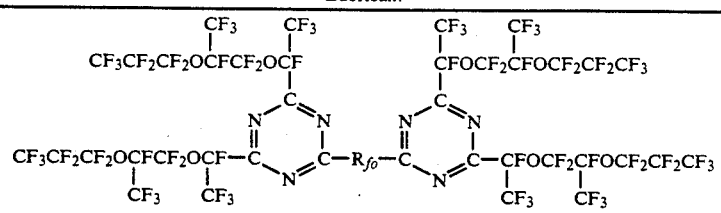 | lower than 50 ppm |
| Comparative Example No. 16 | 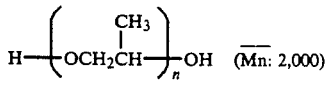 (Mn: 2,000) | 40,000 ppm |
| 17 | SUNISO ® 5GS *7 | 100 ppm |

Note:
*7: naphthene type mineral oil supplied by Nippon San Sekiyu, Japan

EXAMPLES 60 AND 61 AND COMPARATIVE EXAMPLE 18

Viscosity (versus temperature)

The kinetic viscosities of various compounds of the present invention at 40° C. and 100° C. were measured. The obtained results are shown in Table 10 together with the data obtained with respect to a mineral oil.

It was found that in the compound of formula (I) to be used in the present invention, the difference between the viscosities at 100° C. and 40° C. is very small and the viscosity-temperature characteristics are good.

TABLE 10

| Example No. | Lubricant | Kinetic viscosity (cst) 40° C. | Kinetic viscosity (cst) 100° C. | Viscosity ratio 40° C./100° C. |
|---|---|---|---|---|
| 60 | 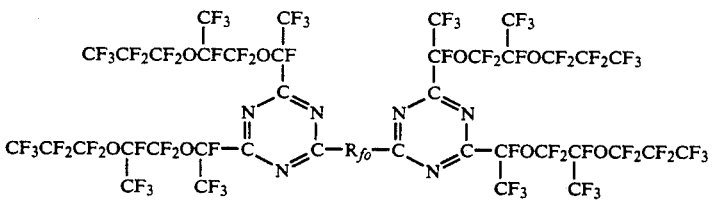 | 81 | 8.7 | 0.107 |
| 61 | 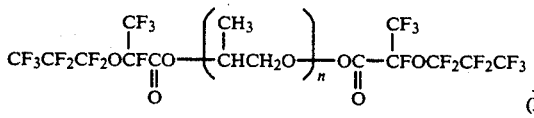 (Mn: 2,300) | 78 | 14 | 0.178 |
| Comparative Example No. 18 | SUNISO ® 5GS *7 | 97 | 8 | 0.083 |

Note:
*7: naphthene type mineral oil supplied by Nippon San Sekiyu, Japan

INDUSTRIAL APPLICABILITY

When a compound containing a fluorine-containing group and a multiple bond-containing group as indispensable constituents is used as a lubricant for a refrigeration system in accordance with the present invention, the lubricant exhibits a good miscibility with a tetrafluoroethane refrigerant, as represented by HFC-134*a*, over a wide temperature range of from low temperatures to high temperatures, and the compound has a viscosity suitable for a lubricant. Moreover, this lubricant has excellent heat resistance, lubrication properties, electrical insulation properties and viscosity-temperature characteristics and can be used as an excellent lubricant for a refrigeration system.

We claim:

1. A method for imparting lubrication properties to a tetrafluoroethane refrigerant for refrigeration equipment, which comprises adding to said refrigerant a lubricant oil which is miscible at temperatures below −10° C. selected from the group consisting of a fluorine-containing compound (I) and a lubricating composition comprising said compound (I) in an amount of at least 25% by weight, based on said lubricating composition, said compound (I) being represented by the formula:

$$A[(OC_nF_{2n})_m(OC_{l'}F_{2l'})_{m'}X]_p \quad (I)$$

wherein:

X is a multiple bond-containing monovalent group selected from:

(i) a carbonyl-containing group of the formula:

$$-\underset{\underset{O}{\|}}{C}-Y \qquad \text{(II)}$$

wherein Y represents a hydroxyl group, an unsubstituted or partially substituted alkoxy group having form 1 to 300 carbon atoms, an unsubstituted or partially substituted aryloxy group having from 6 to 300 carbon atoms, an unsubstituted or partially substituted alkylthio group having from 1 to 300 carbon atoms, an unsubstituted or partially substituted arylthio group having from 6 to 300 carbon atoms, an unsubstituted or partially substituted amino group having from 0 to 300 carbon atoms, an unsubstituted or partially substituted monovalent aliphatic hydrocarbon residue having from 1 to 100 carbon atoms, or an unsubstituted or partially substituted monovalent aromatic hydrocarbon residue having from 6 to 100 carbon atoms;

p is an integer of from 1 to 3;

A represents an unsubstituted or partially substituted mono-, bi- or trivalent perfluorocarbon residue having from 1 to 15 carbon atoms, or an unsubstituted or partially substituted mono-, bi- or trivalent perfluoroether residue having from 2 to 15 carbon atoms, or an unsubstituted or partially substituted mono-, bi- or trivalent perfluoropolyether having from 3 to 15 carbon atoms;

l is an integer of from 1 to 3;

m is an integer of from 0 to 80;

m' is 0 or 1; and n is an integer of from 1 to 4;

wherein when said p and/or said m is not smaller than 2, the units of ( $OC_nF_{2n}$) are the same or different and are not replaced or are replaced with a unit or units of the formula:

$$\left(CF_2-\underset{\underset{B-X'}{|}}{CF}-O\right) \qquad \text{(IV)}$$

wherein B represents a bivalent perfluorocarbon residue having from 1 to 15 carbon atoms, a bivalent perfluoroether residue having from 2 to 15 carbon atoms, or a bivalent perfluoropolyether residue having form 3 to 15 carbon atoms, and X' has the same meaning as defined for X of formula (I), with the proviso that the number of unit or units or ( $OC_nF_{2n}$) replaced by a unit or units of the formula (IV) is not greater than 30% of the total number of said units of ( $OC_nF_{2n}$); and wherein when said p is not smaller than 2, said multiple bond-containing monovalent X group is the same or different.

2. The method according to claim 1, wherein said tetrafluoroethane is 1,1,1,2-tetrafluoroethane.

3. The method according to claim 1, wherein the partially substituted perfluorocarbon, perfluoroether or perfluoropolyether residue of A of formula (I) is substituted with a hydrogen atom, a chlorine atom, a bromine atom, a iodine atom or a group as defined as said multiple bond-containing monovalent X group, with the proviso that the number of substituted fluorine atom or atoms is not greater than 50% of the total number of fluorine atoms of each respective unsubstituted perfluorocarbon, perfluoroether or perfluoropolyether residue.

4. The method according to any one of claims 1, 2 and 3, wherein the weight ratio of said refrigerant to said lubricant oil is 99/1 to 1/99.

5. The refrigerant composition according to claim 1, wherein said tetrafluoroethane is 1,1,2,2-tetrafluoroethane.

* * * * *